US008292790B2

(12) United States Patent
Signorile et al.

(10) Patent No.: US 8,292,790 B2
(45) Date of Patent: Oct. 23, 2012

(54) STABILITY BALL CONTROL DEVICE WITH RADIAL CONTROL SURFACES OF INCREASING WIDTHS

(75) Inventors: Joseph F. Signorile, Miami, FL (US); Samuel S. Hollander, Coral Gables, FL (US)

(73) Assignee: Concept One International LLC, Coral Gables, FL (US)

( * ) Notice: Subject to any disclaimer, the term of this patent is extended or adjusted under 35 U.S.C. 154(b) by 0 days.

(21) Appl. No.: 13/468,317

(22) Filed: May 10, 2012

(65) Prior Publication Data

US 2012/0220431 A1 Aug. 30, 2012

Related U.S. Application Data

(60) Division of application No. 13/154,742, filed on Jun. 7, 2011, which is a continuation-in-part of application No. 13/079,574, filed on Apr. 4, 2011, now Pat. No. 8,012,074, and a continuation-in-part of application No. 12/847,566, filed on Jul. 30, 2010, now Pat. No. 7,942,796.

(51) Int. Cl.
*A63B 26/00* (2006.01)

(52) U.S. Cl. ..... 482/142; 482/143; 482/148

(58) Field of Classification Search ..... 482/110, 482/129, 130, 140, 142–148; 434/247; 446/220
See application file for complete search history.

(56) References Cited

U.S. PATENT DOCUMENTS

| | | | | |
|---|---|---|---|---|
| 3,586,321 | A | 6/1971 | Gehrke | |
| 6,730,005 | B1 | 5/2004 | Liao | |
| 6,746,372 | B2 | 6/2004 | Hsu | |
| D521,084 | S | 5/2006 | Huang | |
| 7,044,558 | B2 | 5/2006 | Chiu | |
| 7,311,644 | B2 | 12/2007 | Hale | |
| 7,344,487 | B2 | 3/2008 | Carter et al. | |
| 7,575,540 | B1 * | 8/2009 | Dobrow et al. | 482/142 |
| 7,588,522 | B2 * | 9/2009 | Heitzman | 482/142 |

(Continued)

FOREIGN PATENT DOCUMENTS

| | | |
|---|---|---|
| CA | 2410704 | 5/2004 |
| DE | 9010548 | 11/1990 |

OTHER PUBLICATIONS

International Search Report of PCT/US10/44043.

(Continued)

*Primary Examiner* — Glenn Richman
(74) *Attorney, Agent, or Firm* — Mayback + Hoffman, P.A.; Gregory L. Mayback; Rebecca A. Tie

(57) ABSTRACT

An exercise device includes at least one arc-shaped wing structure shaped to conform to a curvature of an exterior surface of an exercise ball such that when applied to the exterior surface thereof the at least one arc-shaped wing structure has a lower proximal end and an upper distal radiating end, protrudes away from the exterior surface of the exercise ball to a given distance that increases along a direction from the lower proximal end towards the upper distal radiating end, and is operable to provide an increased resistance against a rolling movement of the exercise ball along a surface when the at least one arc-shaped wing structure comes into rolling contact with the surface. An exercise ball with a plurality of the wing structures is likewise provided, the wing structures being integral or removable.

20 Claims, 39 Drawing Sheets

U.S. PATENT DOCUMENTS

| | | | | |
|---|---|---|---|---|
| 7,674,216 | B1 | 3/2010 | Bolling | |
| 7,691,036 | B1 | 4/2010 | Julian et al. | |
| 7,901,339 | B2 | 3/2011 | Schechter | |
| 8,056,976 | B1 * | 11/2011 | Polk | 297/271.5 |
| 2007/0066461 | A1 | 3/2007 | Carter et al. | |

OTHER PUBLICATIONS

Marshall, Paul W., et al., "Core Stability Exercises On and Off a Swiss Ball," Arch Phys Med Rehabil vol. 86, Feb. 2005, 242-249.

Marshall, Paul W., et al., "Increased Deltoid and Abdominal Muscle Activity During Swiss Ball Bench Press," Journal of Strength and Condition Research, 2006, 20(4), 745-750.

Stanton, Robert, et al., "The Effect of Short-Term Swiss Ball Training on Core Stability and Running Economy," Journal of Strength and Conditioning Research, 2004, 18(3), 522-528.

Willardson, Jeffrey M., "Core Stability Training: Applications to Sports Conditioning Programs," Journal of Strength and Conditioning Research, 2007, 21(3), 979-985.

* cited by examiner

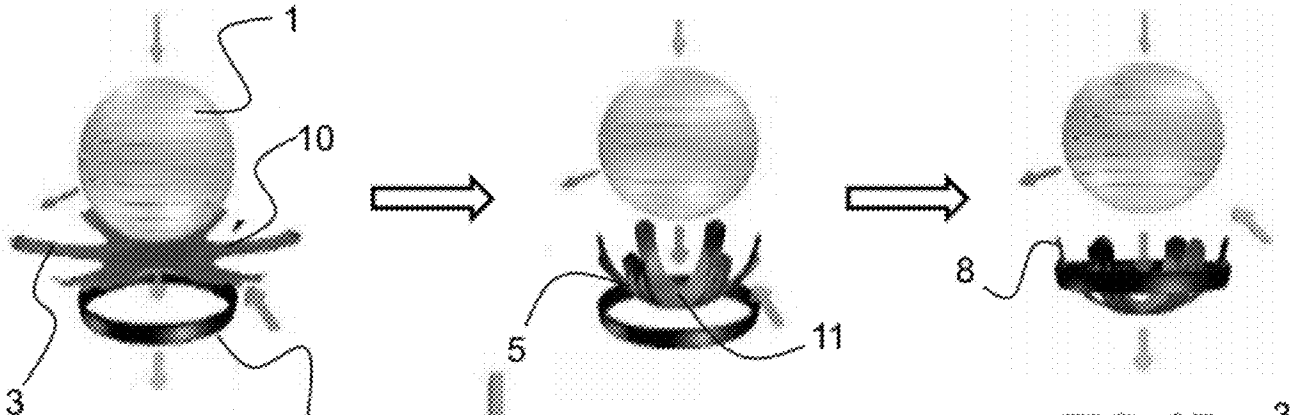
FIG. 25
FIG. 26
FIG. 27
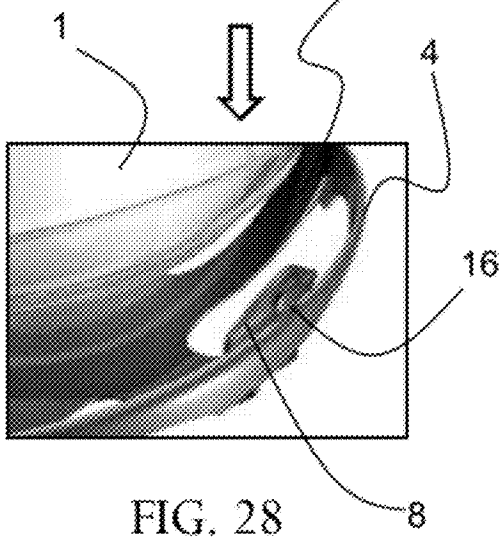
FIG. 28
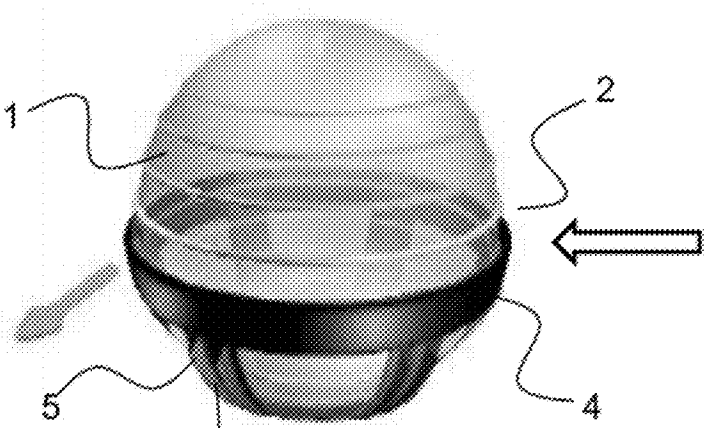
FIG. 29

STABILITY BALL CONTROL DEVICE WITH RADIAL CONTROL SURFACES OF INCREASING WIDTHS

CROSS-REFERENCE TO RELATED APPLICATIONS

This application is:

- a divisional application of U.S. patent application Ser. No. 13/154,742 to Signorile et al., filed on Jun. 6, 2011;
- a continuation-in-part application of U.S. patent application Ser. No. 13/079,574 to Signorile et al., filed on Apr. 4, 2011; and
- a continuation-in-part application of U.S. patent application Ser. No. 12/847,566 to Signorile et al., filed on Jul. 30, 2010 (which application claims the priority, under 35 U.S.C. §119, of U.S. Provisional Patent Application Ser. No. 61/230,348, filed Jul. 31, 2009), the entire disclosures of which are hereby incorporated herein by reference in their entireties.

FIELD OF INVENTION

The present invention lies in the field of core training exercise equipment. More specifically, the present disclosure relates to a "cage" or "enclosure" that is comprised of widening rib-like elements (e.g., six) that radiate from the base of an exercise stability ball and attach to a belt that surrounds the ball just below the ball's center circumference. Protruding from each rib-like element is at least one constantly widening inclined plane or wing that forces the enclosed ball back to its base position and increases the resistance as the ball rolls away from that base position.

BACKGROUND OF THE INVENTION

Core training has developed into one of the most important concepts in fitness training. Exercise scientists, biomechanists, physical therapists, strength and conditioning coaches and personal trainers all realize the critical link that the central or "core" muscles play in stabilizing the trunk (especially, the lower back) and transferring force and power from the legs to the upper body musculature. One of the most important and commonly used pieces of equipment employed during core training is the stability ball, sometimes referred to as the "Swiss ball." Like the prior-art device shown in FIG. 1A, stability balls provide a rolling or unstable surface on which exercises are performed. The instability of the ball requires the exerciser to compensate during the exercise using his or her musculature to maintain control of the ball throughout the exercise. A primary benefit of exercise ball training, as opposed to exercising on a hard flat surface, is that the body responds to the instability of the ball to remain balanced thereby engaging many more muscles. Those muscles become stronger over time to keep balanced. Most frequently, the "core" body muscles are the focus of exercise ball programs.

However, the stability ball has two major flaws. The first, and perhaps the most pressing because it prevents many persons from using the ball and more advanced users from performing advanced exercises, is the tendency of the ball to roll away from the user. This tendency adds an element of fear that precludes the utilization of stability balls by many potential users. The second flaw is that the stability ball offers no changes in resistance to movement throughout the range of motion of the exercise. In addition, the resistance offered by the ball decreases as it becomes increasingly unstable at the end ranges of an exercise.

Scientific literature has demonstrated the positive impact of stability ball training on neuromuscular function over the past decade and the support in the literature has increased significantly over the last five years. See, e.g., J. M. Willardson, *Core stability training: applications to sports conditioning programs*, J Strength Cond. Res. 2007 August 21(3):979-985; P. W. Marshall, B. A. Murphy, *Increased deltoid and abdominal muscle activity during Swiss ball bench press*, J Strength Cond. Res. 2006 November 20(4):745-50; P. W. Marshall, B. A. Murphy, *CORE stability exercises on and off a Swiss ball*, Arch. Phys. Med. Rehabil. 2005 February 86(2):242-249; R. Stanton, P. R. Reaburn, B. Humphries, *The effect of short-term Swiss ball training on core stability and running economy*, J Strength Cond. Res. 2004 August 18(3): 522-8. Currently, there are platforms that hold stability balls in place preventing them from rolling (Aeromat Stability Ball Base, STACCA.com) or that are used for storage (Power Systems Inc.), but no device or system exists that allows stabilization of the stability ball while still permitting continued functional core exercising on the ball.

Accordingly, a need exists to overcome the problems discussed above.

SUMMARY OF THE INVENTION

The device of the instant invention provides a unique control system that can maximize the benefit of one of the most important core exercise apparatuses, the stability ball. The inventive device incorporates a "cage" or "enclosure" that is comprised of a plurality of flexible bands that lock into or are integral with a connecting structure to form a radial configuration such that when assembled together, the device encloses the stability ball to control the ball's movement.

Embodiments of the present invention provide an exercise device comprising a central hub, a plurality of rib structures radiating from the central hub, each rib structure having a proximal end secured at the central hub and terminating at a distal, radiating end, and a band secured to the distal end of each rib structure such that the plurality of rib structures and the band form an enclosure operable to seat therein a bottom portion of an exercise ball.

With the objects of the present invention in view, the central hub is one of solid and annular.

With the objects of the present invention in view, the enclosure permits a rolling movement of the exercise ball along a surface when the exercise ball is seated therein.

With the objects of the present invention in view, each rib structure is operable to come into rolling contact with the surface as the exercise ball and the enclosure are, together, rolled along the surface in a respective direction of the rib structure.

In accordance with another feature of the present invention, at least one of the rib structures biases the exercise ball in a direction opposing the rolling direction when the at least one rib structure comes into rolling contact with the surface.

In accordance with another feature of the present invention, each rib structure is shaped to bias the exercise ball in a direction opposing the rolling direction when the rib structure comes into rolling contact with the surface.

In accordance with another feature of the present invention, an embodiment of the present invention includes a pedestal secured to the central hub and operable to hold still the enclosure irrespective of a rolling movement of the exercise ball while the exercise ball is seated in the enclosure.

In accordance with yet another feature of the present invention, an embodiment of the present invention further comprises at least one roller positioned about at least one of the central hub and the band and operable to come into brushing contact with a surface of the exercise ball when the exercise ball is seated in the enclosure such that the rolling movement of the exercise ball causes the at least one roller to at least one of correspondingly revolve thereabout thereby facilitating the rolling movement of the exercise ball within the enclosure, and correspondingly revolve thereabout in a direction opposite the rolling movement of the exercise ball and, thereby, resist the rolling movement of the exercise ball within the enclosure.

Embodiments of the present invention also provide an exercise device comprising a central hub, a plurality of rib structures, each rib structure having a proximal end and a distal end and being secured to the central hub at an intermediate point between the proximal end and the distal end, and a band secured to the distal end of each rib structure such that the central hub, the plurality of rib structures, and the band form an enclosure operable to seat therein a bottom portion of an exercise ball, the proximal ends forming a pedestal operable to hold still the enclosure with respect to ground irrespective of a rolling movement of the exercise ball while the exercise ball is seated in the enclosure.

Embodiments of the present invention further provide an exercise device comprising a central hub, a plurality of rib structures removably attached to and radiating from the central hub, each rib structure having an exterior surface with a longitudinal axis, terminating into a radiating end, and having at least one wing, formed substantially parallel to the longitudinal axis, that protrudes away from the exterior surface to a given distance that increases along a direction towards the radiating end, and a band connected to the radiating end of each rib structure such that the central hub, the plurality of rib structures, and the band form an enclosure to seat therein a bottom portion of an exercise ball, the at least one wing of each rib structure operable to provide an increasing resistance against a rolling movement of the exercise ball along a surface when the exercise ball is seated therein.

In accordance with a feature of the present invention, the central hub is an annular ring exposing therethrough a bottommost portion of the exercise ball when the exercise ball is seated in the enclosure.

In accordance with another feature of the present invention, the band is removably secured to the radiating end of each rib structure.

In accordance with a further feature of the present invention, the at least one wing is operable to come into rolling contact with the surface as the exercise ball and the enclosure are, together, rolled in a direction along the surface, thereby biasing the exercise ball in a direction opposing the rolling direction.

In accordance with yet another feature of the present invention, the diameter of each rib structure widens towards the radiating end of the rib structure.

In accordance with yet another feature of the present invention, the at least one wing is curved and defines a protruding edge, and further comprising at least one modular, arc-shaped enhancer shaped to conform to the curvature of the at least one wing, and operable to be selectively applied to at least a portion of the protruding edge of the at least one wing, thereby increasing a distance that the at least one wing protrudes from the exterior surface of the rib structure.

In accordance with another feature of the present invention, the enhancer comprises an interior groove shaped to receive the portion of the protruding edge of the at least one wing when the enhancer is applied to the at least one wing.

In accordance with a further feature of the present invention, the at least one wing is partitioned to comprise at least two parts.

In accordance with yet another feature of the present invention, the at least two parts of the at least one partitioned wing are interlocked.

In accordance with another feature of the present invention, the at least one wing is curved and defines a protruding edge, and further comprising at least one modular, arc-shaped enhancer shaped to conform to the curvature of at least one of the parts of the at least one partitioned wing, and operable to be selectively applied to at least a portion of the protruding edge of the at least one part of the at least one partitioned wing, thereby increasing a distance that the part protrudes from the exterior surface of the rib structure.

In accordance with a further feature of the present invention, the enhancer comprises an interior groove shaped to receive the portion of the protruding edge of the at least one part of the at least one partitioned wing when the enhancer is applied to the at least one part.

With the objects of the invention in view, there is also provided an exercise device, comprising at least one arc-shaped wing structure shaped to conform to a curvature of an exterior surface of an exercise ball such that when applied to the exterior surface of the exercise ball the at least one arc-shaped wing structure has a lower proximal end and an upper distal radiating end, protrudes away from the exterior surface of the exercise ball to a given distance that increases along a direction from the lower proximal end towards the upper distal radiating end, and is operable to provide an increased resistance against a rolling movement of the exercise ball along a surface when the at least one arc-shaped wing structure comes into rolling contact with the surface.

With the objects of the invention in view, there is also provided an exercise device, comprising an exercise ball having a curved exterior surface and at least one arc-shaped wing structure shaped to conform to the curvature of the exterior surface of the exercise ball such that when applied to the exterior surface of the exercise ball the at least one arc-shaped wing structure has a lower proximal end and an upper distal radiating end, protrudes away from the exterior surface of the exercise ball to a given distance that increases along a direction from the lower proximal end towards the upper distal radiating end, and is operable to provide an increased resistance against a rolling movement of the exercise ball along a surface when the at least one arc-shaped wing structure comes into rolling contact with the surface.

With the objects of the invention in view, there is also provided an exercise device comprising an exercise ball having a curved exterior surface and at least one arc-shaped wing molded so that it is part of or continuous with the wall of the ball and derives its support from the internal pressure of the ball and the wing's inherent shape has a lower proximal end and an upper distal radiating end, protrudes away from the exterior surface of the exercise ball to a given distance that increases along a direction from the lower proximal end towards the upper distal radiating end, is operable to provide an increased resistance against a rolling movement of the exercise ball along a surface when the at least one arc-shaped wing structure comes into rolling contact with the surface, and inflates along with the exercise ball as a single unit.

In accordance with another feature of the invention, the exercise ball has an exterior surface, the at least one arc-shaped wing structure being integral with the exterior surface of the exercise ball.

In accordance with a further feature of the invention, the at least one arc-shaped wing structure further comprises at least one mechanical structure operable to attach the at least one arc-shaped wing structure to the exterior surface of the exercise ball.

In accordance with an added feature of the invention, the at least one mechanical structure is at least one of temporary, permanent, and semi-permanent.

In accordance with an additional feature of the invention, the at least one mechanical structure is an adhesive.

In accordance with yet another feature of the invention, the at least one mechanical structure is a hook and loop fastener applied to adjacent surfaces of the ball and the at least one arc-shaped wing structure.

In accordance with yet a further feature of the invention, the at least one mechanical structure is a male pin and matching female keyhole-slot adjoin corresponding adjacent parts of the ball and the at least one arc-shaped wing structure.

In accordance with yet an added feature of the invention, there is provided an exercise ball having a spherical exterior surface, the at least one arc-shaped wing structure being shaped to conform to the spherical exterior of the ball.

In accordance with yet an additional feature of the invention, the at least one arc-shaped wing structure is of a flexible molded plastic.

In accordance with again another feature of the invention, the at least one arc-shaped wing structure is at least one of solid, partially hollow, and fully hollow.

In accordance with again a further feature of the invention, the at least one arc-shaped wing structure is of a flexible molded plastic.

In accordance with again an added feature of the invention, the at least one arc-shaped wing structure is operable to provide an adjustable amount of increased resistance against a rolling movement of the exercise ball.

In accordance with again an additional feature of the invention, the at least one arc-shaped wing structure is a plurality of arc-shaped wing structures.

In accordance with still another feature of the invention, the plurality of arc-shaped wing structures is at least four arc-shaped wing structures symmetrically disposed about the exterior surface of the exercise ball.

In accordance with still a further feature of the invention, each of the plurality of arc-shaped wing structures is at least one of solid, partially hollow, and fully hollow.

In accordance with still an added feature of the invention, there is provided at least one support, at least one of the partially hollow and fully hollow arc-shaped wing structures defining a pocket operable to receive therein the at least one support.

In accordance with still an additional feature of the invention, the at least one support is weighted to bias the exercise ball against the rolling movement of the exercise ball along a surface when the at least one arc-shaped wing structure comes into rolling contact with the surface.

In accordance with a concomitant feature of the invention, there is provided a plurality of supports, the partially hollow and fully hollow arc-shaped wing structures each defining a pocket operable to receive therein one of the plurality of supports. Each support can be user-removable from each of the pockets in the partially hollow and fully hollow arc-shaped wing structures.

Additional advantages and other features characteristic of the present invention will be set forth in the detailed description that follows and may be apparent from the detailed description or may be learned by practice of exemplary embodiments of the invention. Still other advantages of the invention may be realized by any of the instrumentalities, methods, or combinations particularly pointed out in the claims. The construction and method of operation of the invention, however, together with additional objects and advantages thereof, will be best understood from the following description of specific embodiments when read in connection with the accompanying drawings.

Although the invention is illustrated and described herein as embodied in a stability ball control device with radial control surfaces of increasing widths, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims.

BRIEF DESCRIPTION OF THE DRAWINGS

Advantages of embodiments of the present invention will be apparent from the following detailed description of the preferred embodiments thereof, which description should be considered in conjunction with the accompanying drawings in which:

FIGS. 25-28 illustrate the steps of assembling the exercise device of FIG. 7 and applying the device to a stability ball according to an exemplary embodiment of the present invention;

FIG. 29 shows the exercise device of FIG. 7 in a fully assembled configuration following the steps shown in FIGS. 25-28;

DETAILED DESCRIPTION OF THE INVENTION

Figure 1A:
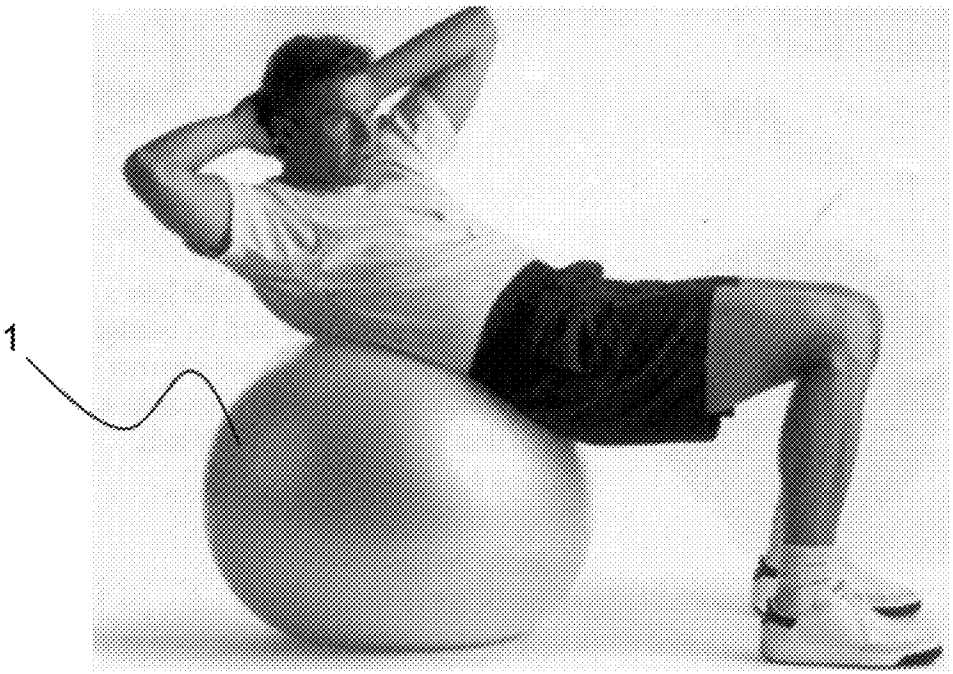
FIG. 1A PRIOR ART
FIG. 1A is a prior-art device stability ball that is incorporated into an exercise movement of the user.
Figure 2:
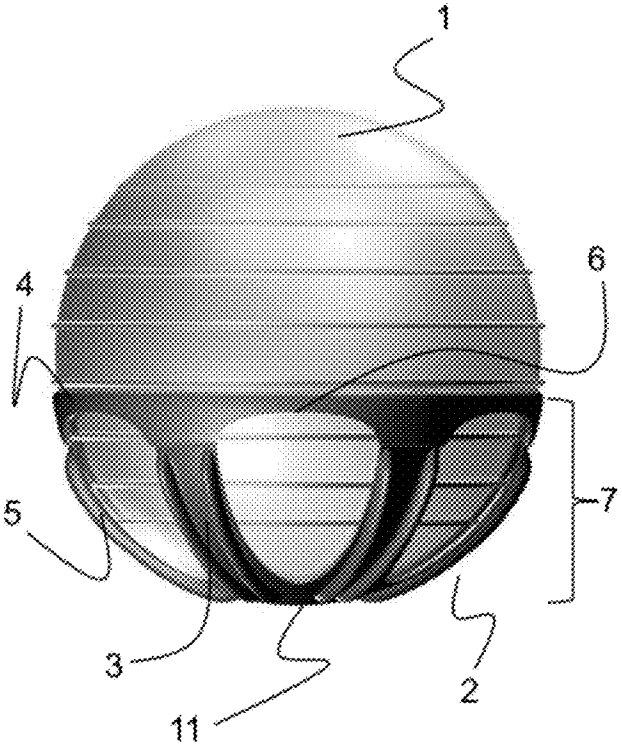
FIG. 2 is a side view of the exercise device of FIG. 1 in a fully assembled configuration and after its application to a stability ball.
Figure 1:
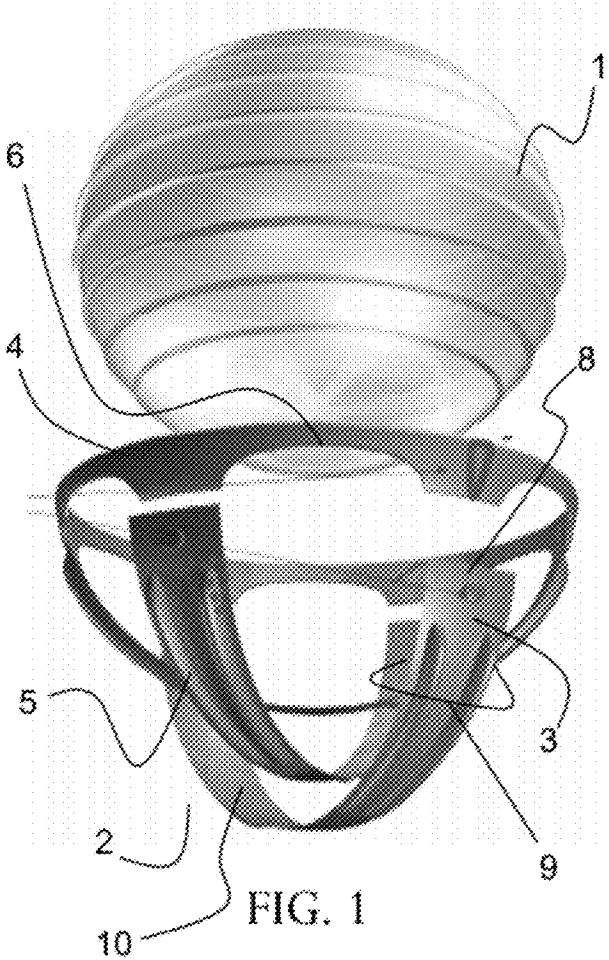
FIG. 1 is an exploded view of a first exemplary embodiment of the exercise device according to the present invention in an unassembled configuration and prior to its application to a stability ball.
Figure 4:
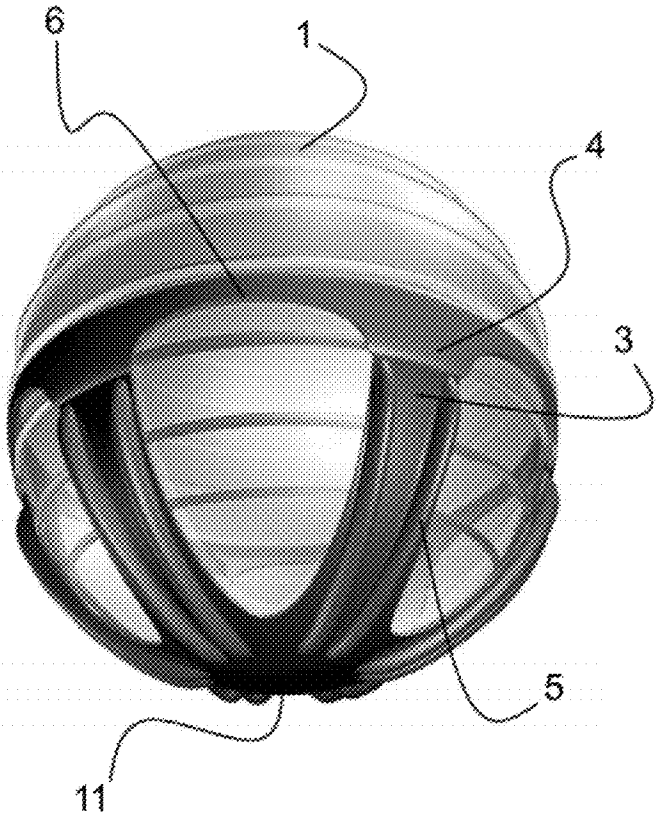
FIG. 4 is a perspective view of the underside of the exercise device of FIG. 2.
Figure 3:
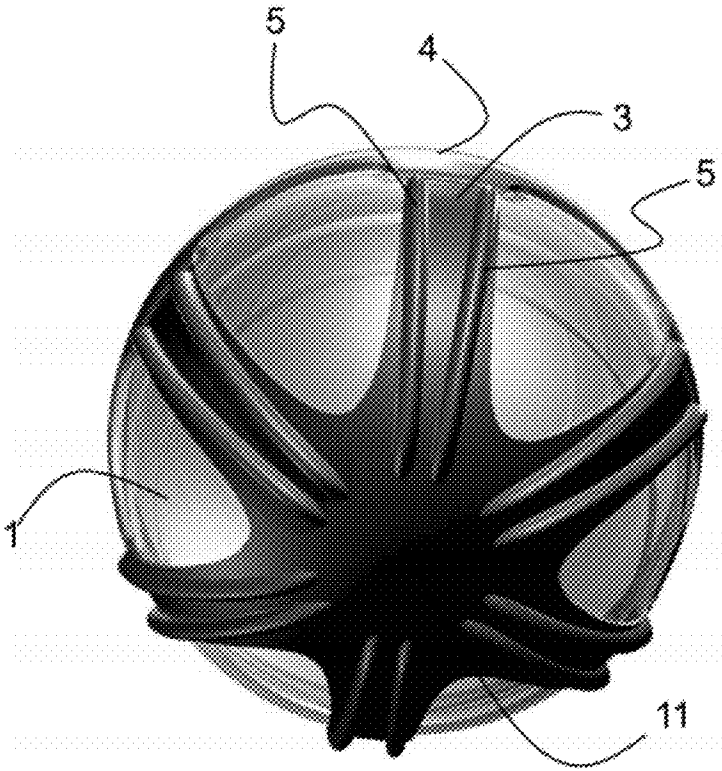
FIG. 3 is a bottom view of the exercise device of FIG. 2.
Figure 6:
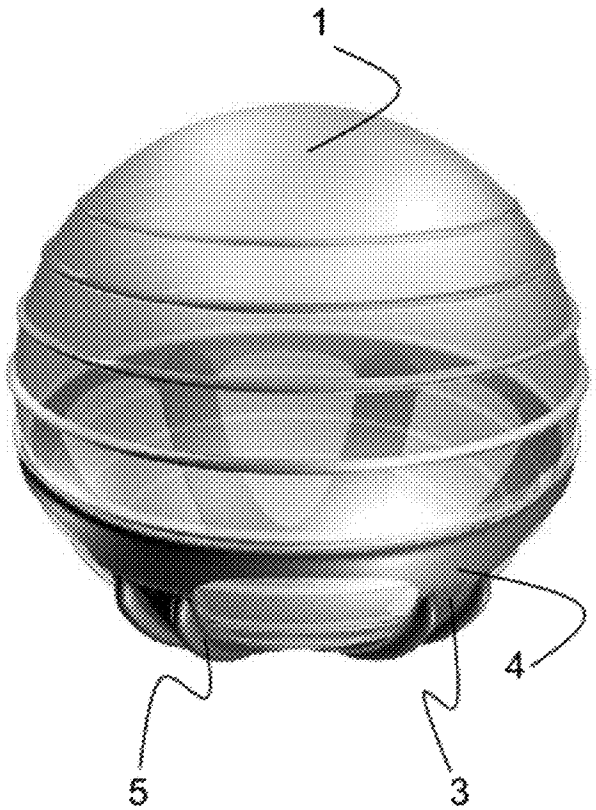
FIG. 6 is a perspective view of the topside of the exercise device of FIG. 2, as well as the interior of the device made visible by the translucency of the stability ball.
Figure 5:
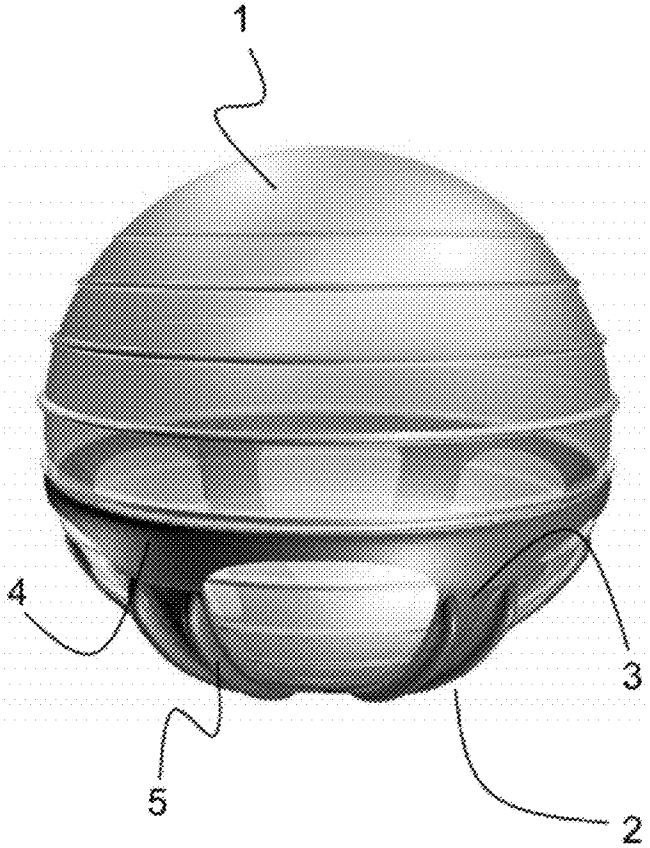
FIG. 5 is a side view of the exercise device of FIG. 2, as well as the interior of the device made visible by the translucency of the stability ball.
Figure 8:
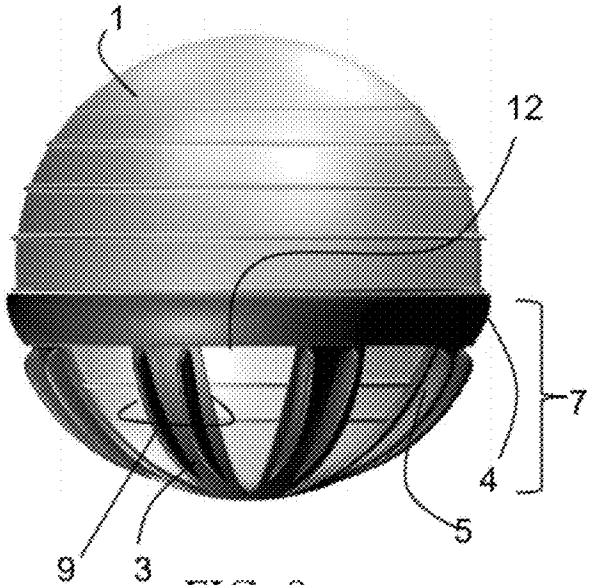
FIG. 8 is a side view of the exercise device of FIG. 7.
Figure 7:
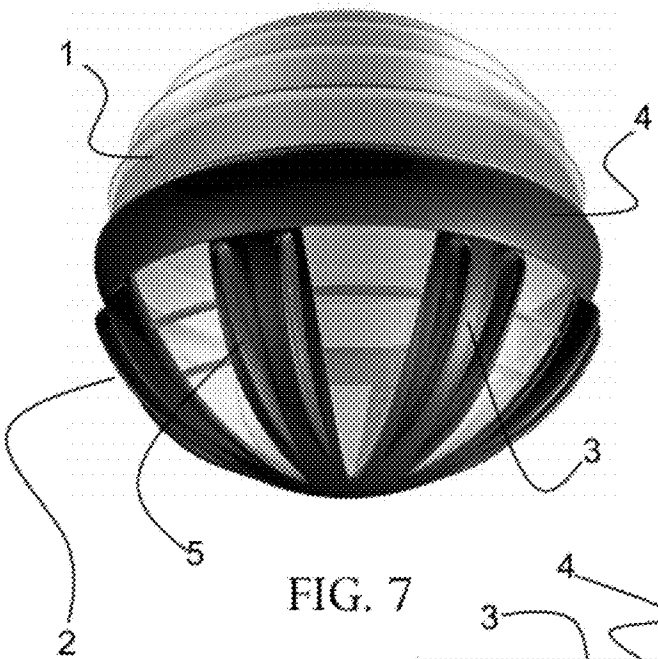
FIG. 7 is a perspective view of the underside of a second exemplary embodiment of the exercise device according to the present invention in a fully assembled configuration and after its application to a stability ball.
Figure 9:
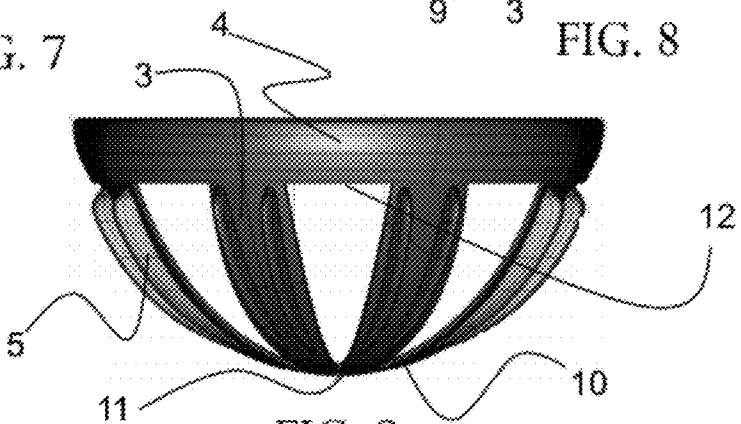
FIG. 9 is a side view of the exercise device of FIG. 7, as it appears when not applied to a stability ball.
Figure 11:
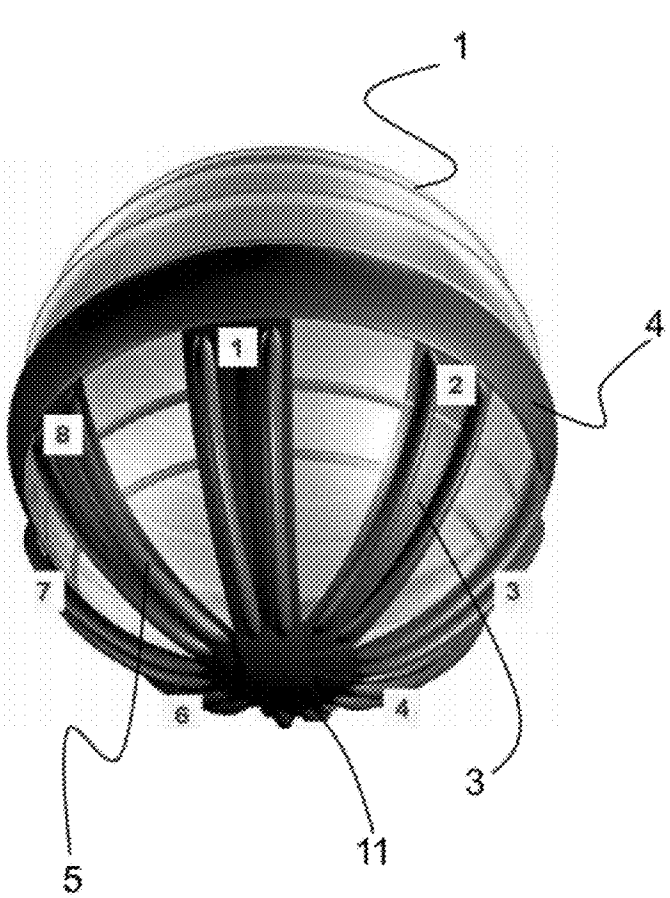
FIG. 11 is another perspective view of the underside of the exercise device of FIG. 7.
Figure 10:
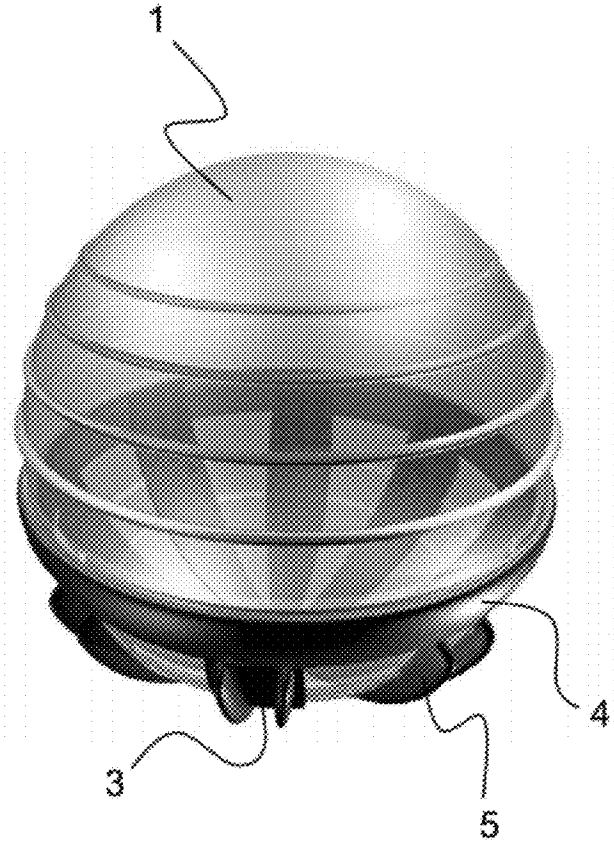
FIG. 10 is a perspective view of the topside of the exercise device of FIG. 7, as well as the interior of the device made visible by the translucency of the stability ball.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

Relational terms such as first and second, top and bottom, and the like may be used solely to distinguish one entity or action from another entity or action without necessarily requiring or implying any actual such relationship or order between such entities or actions. The terms "comprises," "comprising," or any other variation thereof are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the object being described.

The device of the present invention provides a unique way to control the rollaway movements of a stability ball while simultaneously increasing the resistance being applied to the user's body musculature during exercises being performed by the user with the stability ball. FIG. 1A provides an example of the type of stability ball 1, found in the prior art, that would benefit from the inventive device described herein.

The invention incorporates a "cage" or "enclosure" that is comprised of a plurality of flexible bands, or ribs, that lock into or are integral with a connecting structure to form a radial configuration such that when assembled together, the device partially, substantially, or fully cups or encloses a bottom portion of the stability ball to control the stability ball's movement. The flexible bands or ribs have at least one inclined plane or wing on their exterior surface such that when the stability ball is rolled away from its base (i.e., resting) position in any direction along a substantially flat surface, the inclined plane or wing comes into contact with the substantially flat surface to provide an incremental, counteracting or balancing resistance to movement of the ball away from its base position. This resistance is beneficially transferred to the user while the user is performing exercise movements with the stability ball.

Referring now to the figures of the drawings in detail and first, particularly to FIGS. 1 to 6 thereof, there is shown a first exemplary embodiment of the exercise device according to the present invention. The exercise device 2 is comprised of a plurality of flexible rib assemblies 10, bent into a semicircular arc or a bow to form a plurality of widening ribs 3 in a radial configuration, and held equal distances apart by a circular-shaped belt 4 or other connecting structure that surrounds, with a snug fit, the circumference of a stability ball 1 at a height 7 that is, for example, just below or at the midline of the ball. This allows the device to apply resistance and stability throughout the working surface of the ball during most functional exercises. Depending upon the shape of the ball 1, it may be beneficial that the height 7 be above, or just slightly above, the midline of the ball in order to provide a better grip on the ball. It is also envisioned for the height to extend just past the middle plane of the ball and to have the uppermost ball-receiving opening to curve slightly inward. In such an embodiment, with a flexible exercise ball, the exercise device will slightly compress the ball to improve gripping and inhibit the ball from rolling out of the exercise device 2 during use. Together, the rib assemblies 10 and the belt 4 form a concave-shaped, hemispherical "cage" or "enclosure" of approximately the lower half of the stability ball 1 whereby the stability ball is securely seated inside the device 2. In this exemplary embodiment, the rib assemblies 10 are removably anchored or secured to the belt 4 at their radiating ends 8. Although three rib assemblies 10, resulting in six ribs 3, are shown in this particular embodiment, this is for purposes of a non-limiting illustration only. Depending on the amount of desired resistance to the rollaway movement of the stability ball 1, a variable number of rib assemblies 10 may be used to form the device 2. The greater the number of rib assemblies used, the greater amount of resistance will be provided to the ball's movements.

In this particular embodiment, the central base 11 of the device 2 is formed at the point where the rib assemblies 10 overlap and cross one another. When placed on a substantially flat surface, the central base 11 of device 2 provides a base, or resting position for the stability ball 1 when the ball is present. The ribs 3 radiate from this central base 11 in a radial pattern that resembles the flower head of a daisy. In order to best form the concave-shaped, hemispherical "cage" or "enclosure," which most suitably conforms to the spherical shape of the lower half of the stability ball, the diameter of the rib 3 is at its narrowest dimension at the point of the central base 11 and incrementally widens in a direction towards its radiating end 8 of the rib 3. However, it is contemplated by the present invention that the ribs 3 may alternatively be constructed to have any strip-like shape, including a strip with a uniform diameter along its entire length, or, the ribs 3 may be replaced entirely by a single, molded cup-like dome (not shown) (i.e., is not split into a plurality of rib assemblies 10) that encloses the entire lower half of the stability ball.

Figure 30:
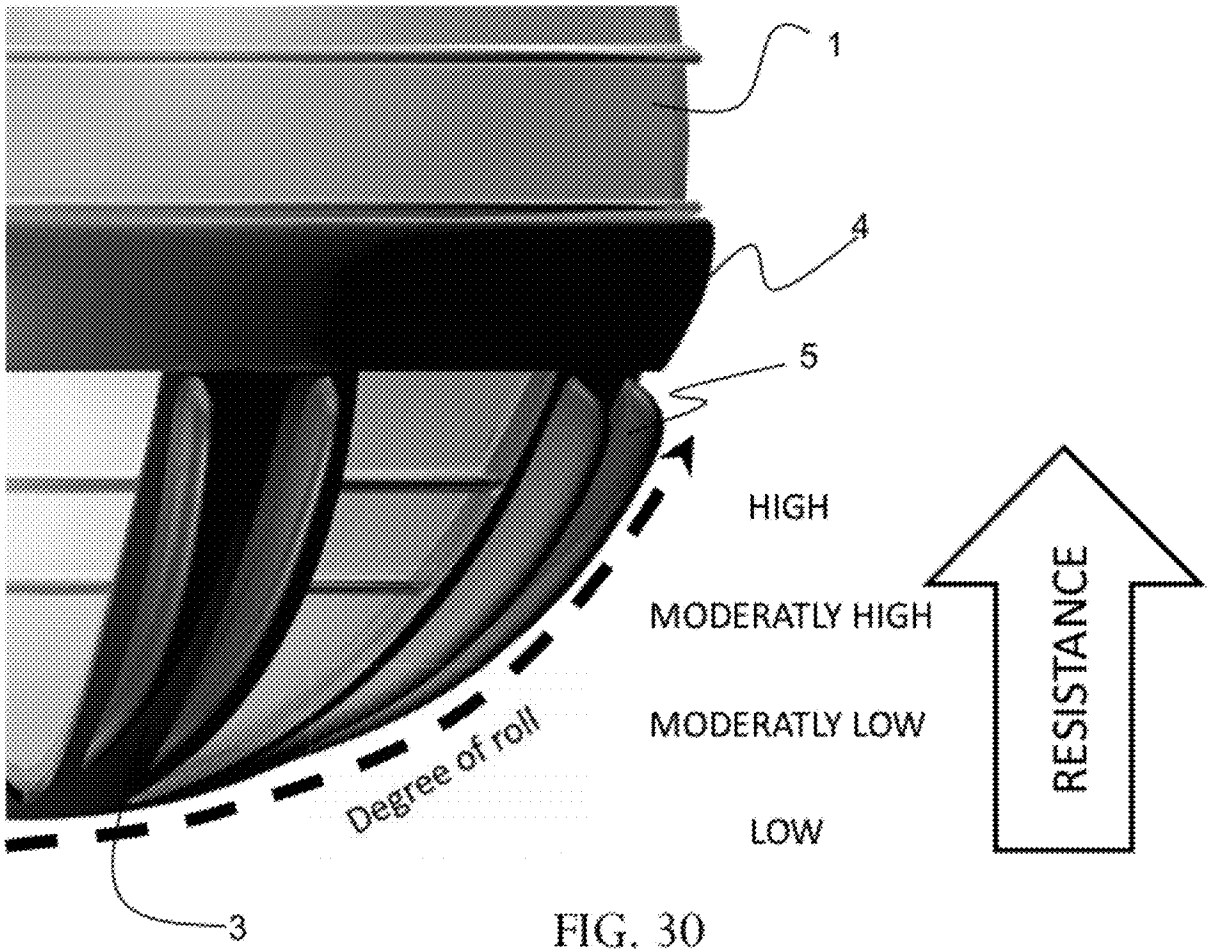
FIG. 30 is a pictorial representation of the relationship between the degree of rotation of the stability ball, when used in conjunction with the inclined planes or wings of the exercise device of the present invention, and the resistance felt by the user.
Figure 31:
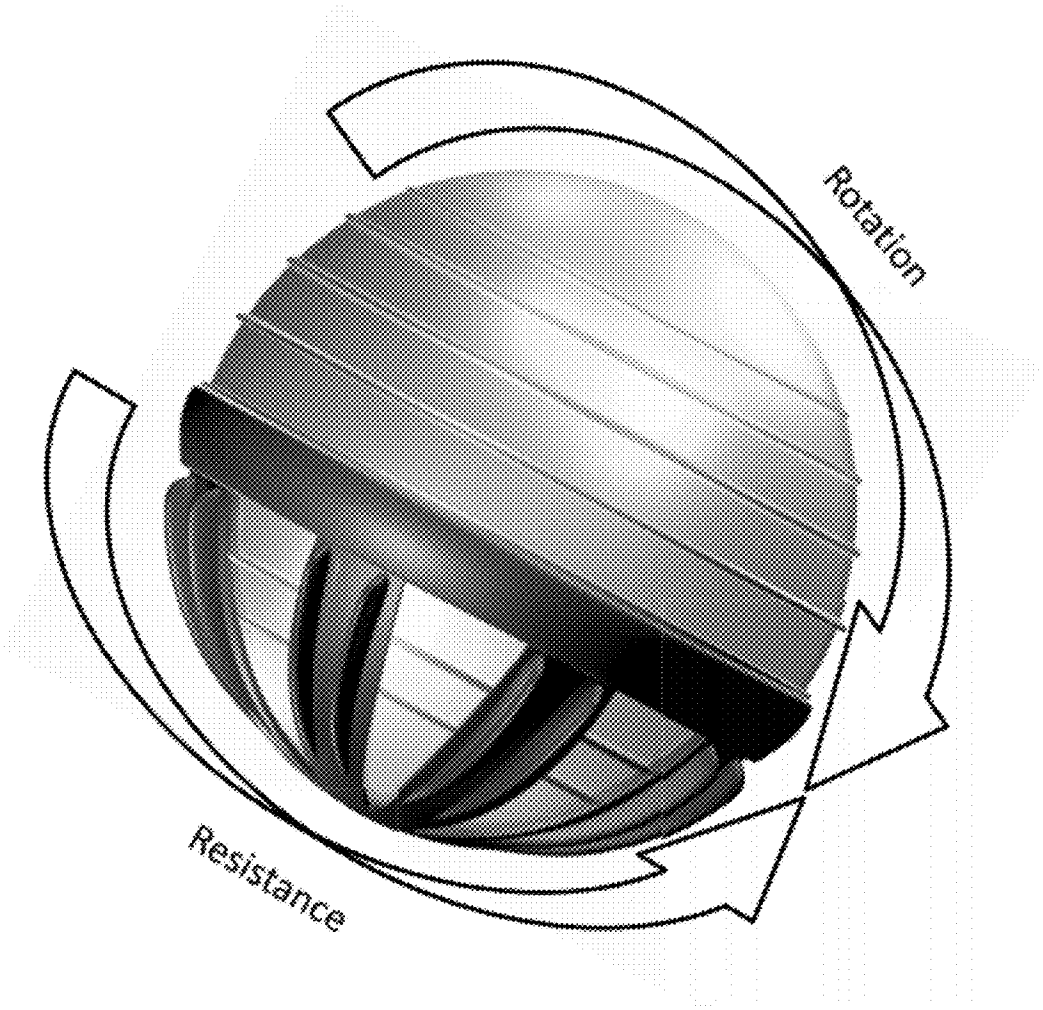
FIG. 31 is another pictorial representation of the relationship between the degree of rotation of the stability ball, when used in conjunction with the inclined planes or wings of the exercise device of the present invention, and the resistance felt by the user.

Incorporated into the exterior surface of each rib 3 (or, the exterior surface of any other structure forming the enclosure of the lower half of the stability ball) is a pair 9 of inclined planes or "wings" 5 that extend substantially parallel to a longitudinal axis of the rib and protrude perpendicularly from the exterior surface of the rib. Each inclined plane or wing 5 steadily increases in its protruding distance, or angle of inclination, as it approaches the radiating or anchoring end 8 of the rib 3 at the belt 4 of the device 2. The addition of these inclined planes or wings 5 to the ribs 3 of the inventive device 2 provides an incremental amount of resistance to the rolling movement of the stability ball 1, thereby requiring a greater muscular effort to move the ball as it rolls further from its base position (i.e., the upright, established position of the ball when it is at rest). FIGS. 30 and 31 graphically illustrate the counteractive or balancing relationship between the degree of the rolling movement of the ball from its base position and the amount of resistance created by the inclined planes or wings 5 of the ribs 3. During exercise movements, the stability ball 1 is naturally inclined to roll away from its base (i.e., resting) position, which is desirable for the user when it is controllable in a stable manner. With the addition of the inventive device 2, as the ball rolls away from its base position in any direction along a substantially flat surface, the inclined planes or wings 5 of the ribs 3 come into contact with the substantially flat surface to provide an increasing, counteracting or balancing resistance to movement of the ball away from its base position in an incremental fashion. In other words, the greater the degree of rollaway motion of the ball from its base position, the greater amount of surface area of the inclined planes or wings 5 come into obstructive contact with the substantially flat surface thereby providing an increased amount of resistance to the ball's movement. The resistance created by the inclined planes or wings 5 of the ribs 3 drives or biases the ball back towards its original, base position. Thus, as the user's exercise movements cause a rotation of the ball in one direction, the ribs increase the resistance in the other direction, which stabilizes the ball's inherent and uncontrolled movements and increases the effectiveness of the exercise. Inventively, the exercise device 2 of the present invention stabilizes the ball while still allowing it to perform its function and with increased resistance experienced by the user.

Referring back to FIGS. 1 to 6, in this particular embodiment, the belt 4 of the device 2 has intermittent curves 6 along its length between the points at which the rib assemblies 10 are removably anchored or secured to the belt 4. In this way, the anchoring or securing points are clearly set apart so that they are easily identifiable by the user and the resulting spatial footprint of the device 2 on the ball 1 is reduced.

The belt 4 and the rib assemblies 10 may be comprised of, but not limited to, heavy-duty nylon. However, other materials including high-impact plastic are feasible.

Additionally, the device 2 may incorporate a supplementary elastic band exercise system (not shown), which allows the user to attach elastic bands to the device thereby adding a resistance-training component to the device.

Figure 12:
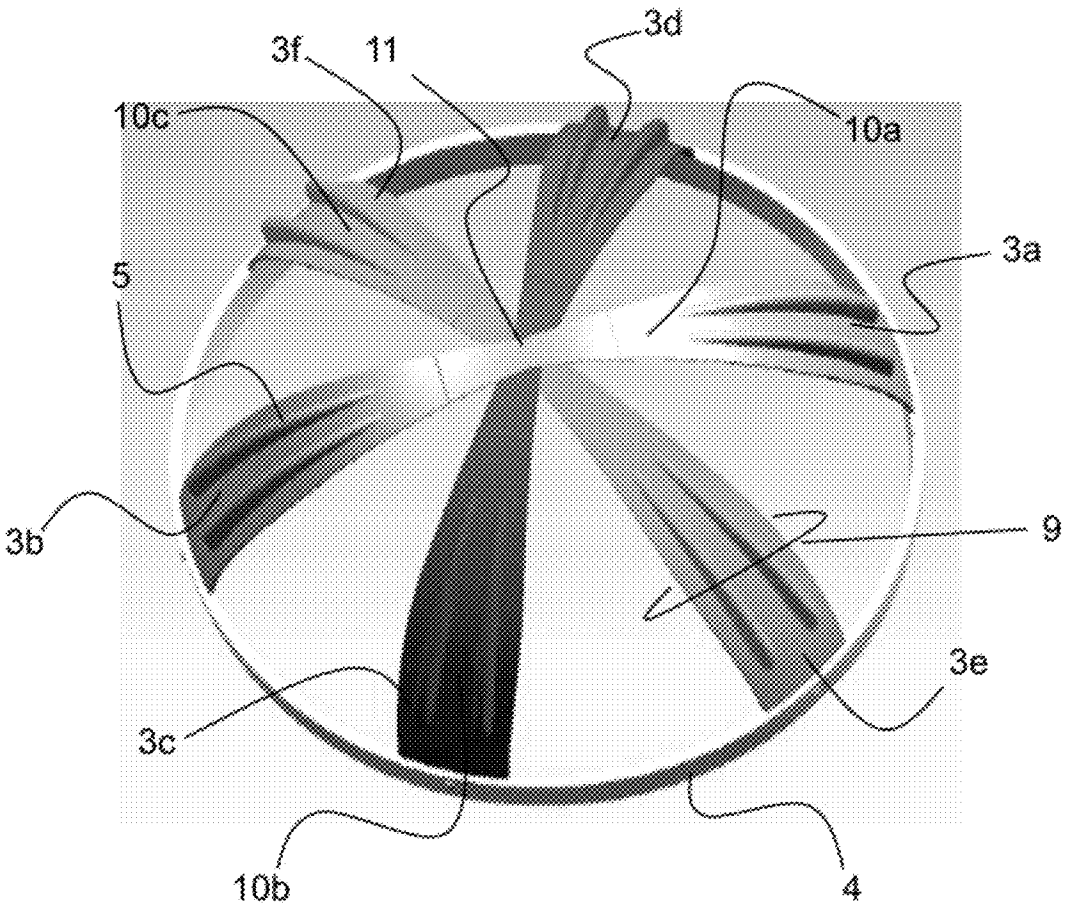
FIG. 12 is a view of the bottom of the exercise device of FIG. 7, having three separate rib assemblies.
Figure 14:
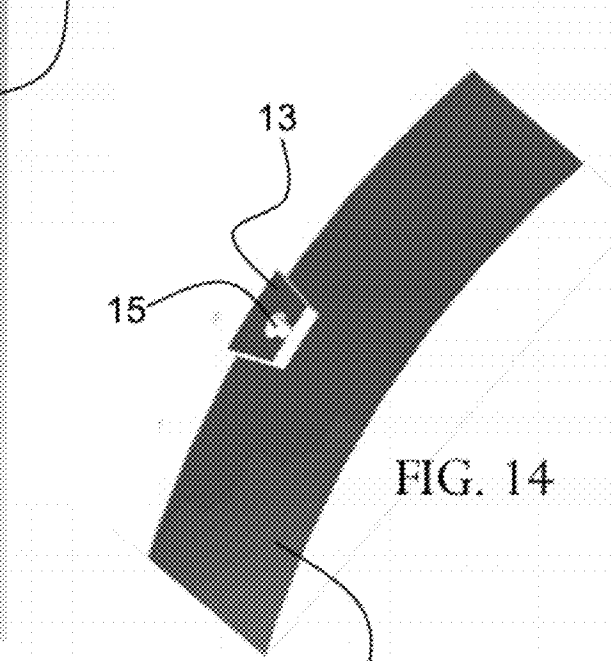
FIG. 14 shows the detail of the trapezoidal indentation on the inner surface of the belt shown in FIG. 13.
Figure 13:
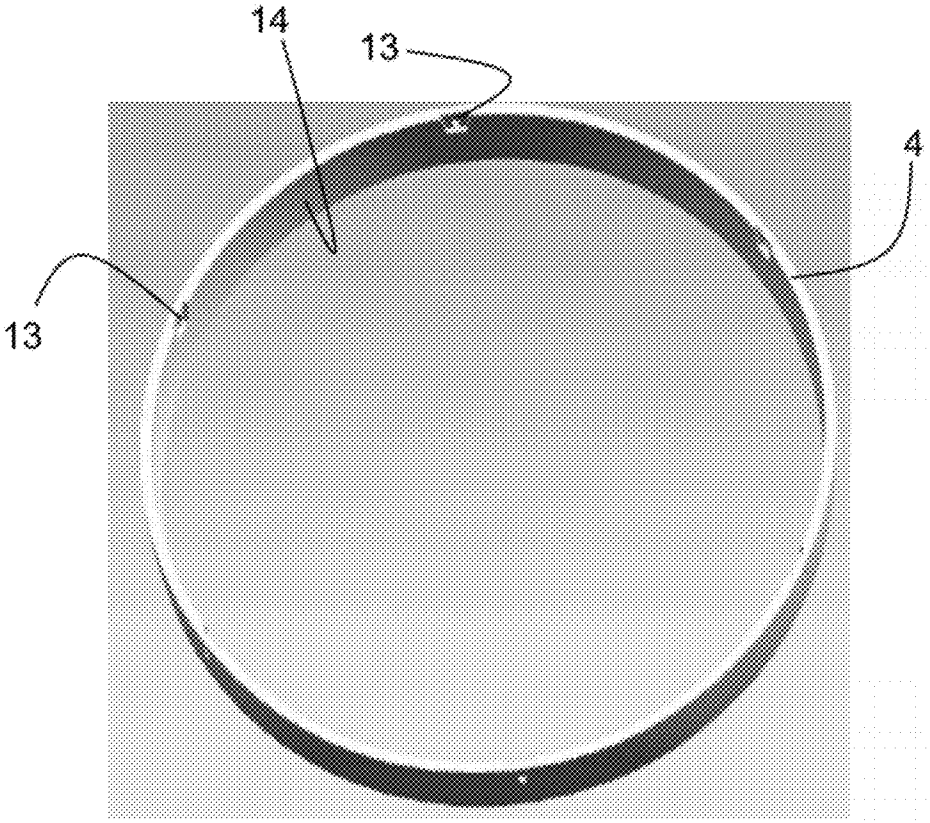
FIG. 13 is a perspective view of the belt of the exercise device of FIG. 7 that surrounds the stability ball and acts as the anchoring point for the ribs whereby the anchoring points are indicated by trapezoidal indentations.

In FIGS. 7 to 17, there is shown a second exemplary embodiment of the exercise device according to the present invention. Similarly to the exemplary embodiment depicted in FIGS. 1 to 6, the exercise device 2 is comprised of a belt 4 that is shaped to tightly surround the circumference of a stability ball 1 just below the ball's midline, and four (as shown in FIGS. 7 to 11) or three (as shown in FIGS. 12 and 13) rib assemblies 10*a*, 10*b*, and 10*c*, flexibly bent into semicircular arcs that are removably, and equidistantly, secured or held in a register to the belt 4 at indentations or notches 13 of the interior surface 14 of the belt 4 (which are shown in detail in FIGS. 13 and 14). Together, the rib assemblies 10*a-c* and the belt 4 form a radially-shaped "cage" or "enclosure" of the lower half of the ball 1. However, in this particular embodiment, the belt 4 does not have intermittent curves along its length and instead, the belt 4 has a constant width 12 along its entire length. As clearly shown in FIGS. 11 and 12, the rib assemblies 10*a-c* come together centrally to form a central base 11, which when placed on a substantially flat surface, provides a base, or resting position for the stability ball 1 when the ball is seated inside the device 2.

Figures 15, 16, 17:
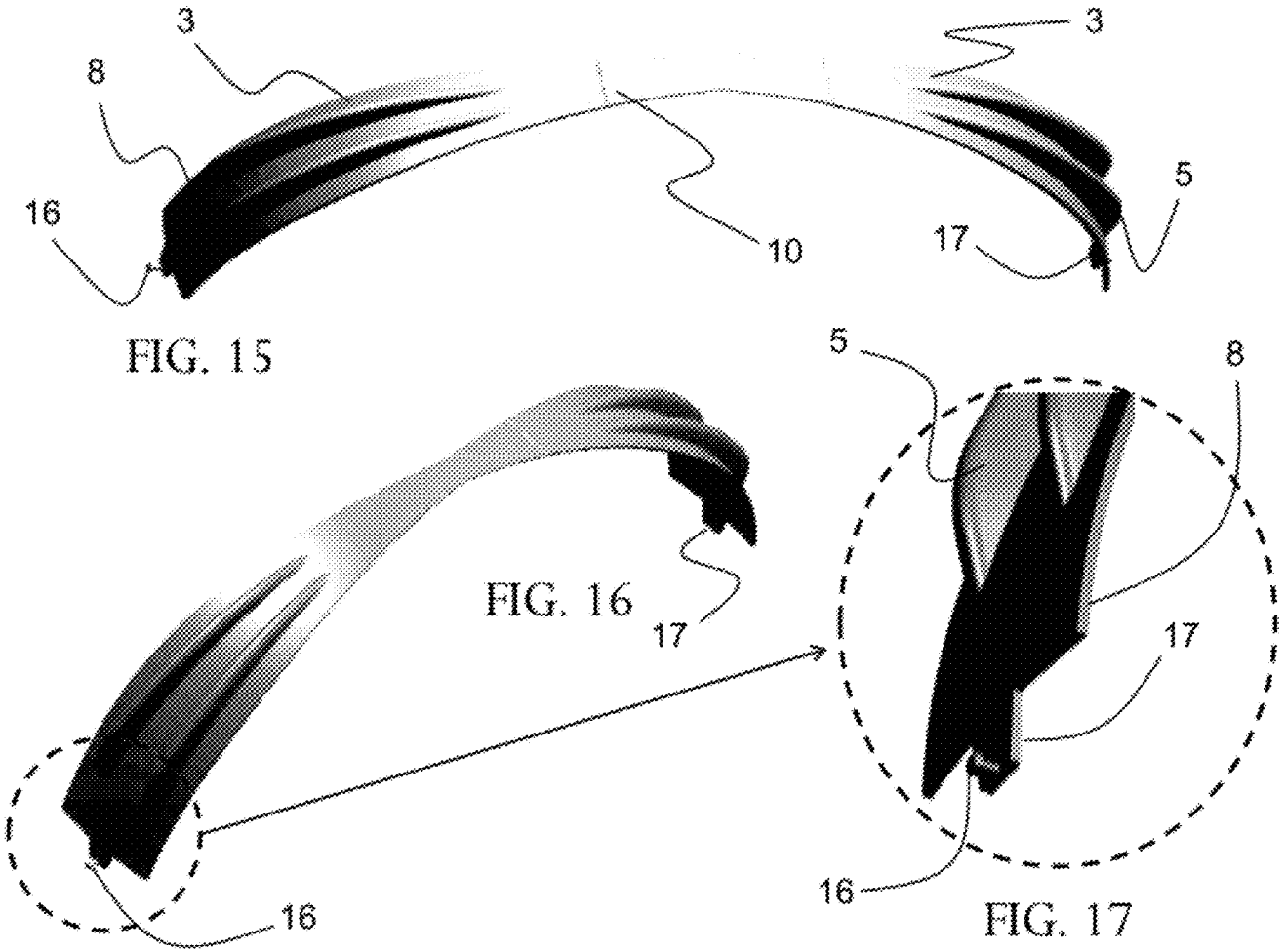
FIG. 15 is a top perspective view of one of the rib assemblies of FIG. 12 showing a pair of inclined planes or wings and end clips that attach to the belt.
FIG. 16 is a perspective view of the rib assembly of FIG. 15.
FIG. 17 shows, in close-up detail, a trapezoidal extension and link pin found at the end clip of the rib assembly of FIGS. 15 and 16, whereby the link pin is accommodated by the keyhole slot of the trapezoidal indentation of the belt shown in FIG. 14.

FIGS. 15 to 17 show, in close detail, any one of the rib assemblies 10*a-c* of FIG. 12. Each rib assembly defines two ribs, 3*a-b*, 3*c-d*, and 3*e-f* that radiate from the central base 11 in a wheel-and-spokes pattern whereby the ribs increasingly widen in a direction away from the central base 11. Each rib has a pair 9 of raised, inclined planes 5 that run substantially parallel along the rib's longitudinal axis. At each radiating end 8 of the rib assembly, there lies a trapezoidal protrusion 17 and a linking pin 16 for securing the rib assembly to the belt 4. To secure each end 8 of the rib assemblies 10*a-c* to the belt 4, a corresponding number of trapezoidal indentations or notches 13, having keyhole slots 15, are formed in the interior surface 14 of the belt 4 (see FIGS. 13 and 14). The trapezoidal indentations or notches 13 are shaped to have a corresponding, or mating fit to the trapezoidal protrusions 17 of the rib assembly and each keyhole slot 15 of the trapezoidal indentations or notches is shaped to retain the linking pin 16 of the rib assembly. By mating both the trapezoidal indentations or notches 13 of the belt with the trapezoidal protrusions 17 of the rib assembly, and the keyhole slots 15 of the belt with the linking pins 16 of the rib assembly, the rib assembly is removably secured to the belt.

To illustrate the sequential steps for assembling the exercise device 2 of FIGS. 7 to 17, and applying the exercise device 2 to a stability ball 1 in accordance with one exemplary embodiment of the present invention, FIGS. 25 to 29 provide a pictorial representation of the assembly-line process. In the first step, as shown in FIG. 25, the rib assemblies 10 are placed between the stability ball 1 and the belt 4 in a substantially flat, radial configuration with the ribbed surface of the rib assemblies facing downwards towards the belt. In the second and third steps, as shown in FIGS. 26 and 27, in a fluid motion using the belt, the rib assemblies 10 are guided upwards into their semicircular arc or bow shape as permitted by the inherent flexibility of the material comprising the rib assemblies 10. As a result, the rib assemblies form a concave-shaped seat, having a central base 11, in which the ball 1 is seated. In the next step, as shown in FIG. 28, the ribs 3 of each rib assembly 10 are removably secured to the belt 4 at their ends 8 by sliding the linking pin 16 into the corresponding keyhole slot 15 (not shown) formed in the interior surface of the belt. Once the rib assemblies are removably secured or anchored to the belt, the resulting device 2, as shown in FIG. 29, tightly captures and encloses the lower portion of the ball 1.

Figure 18:
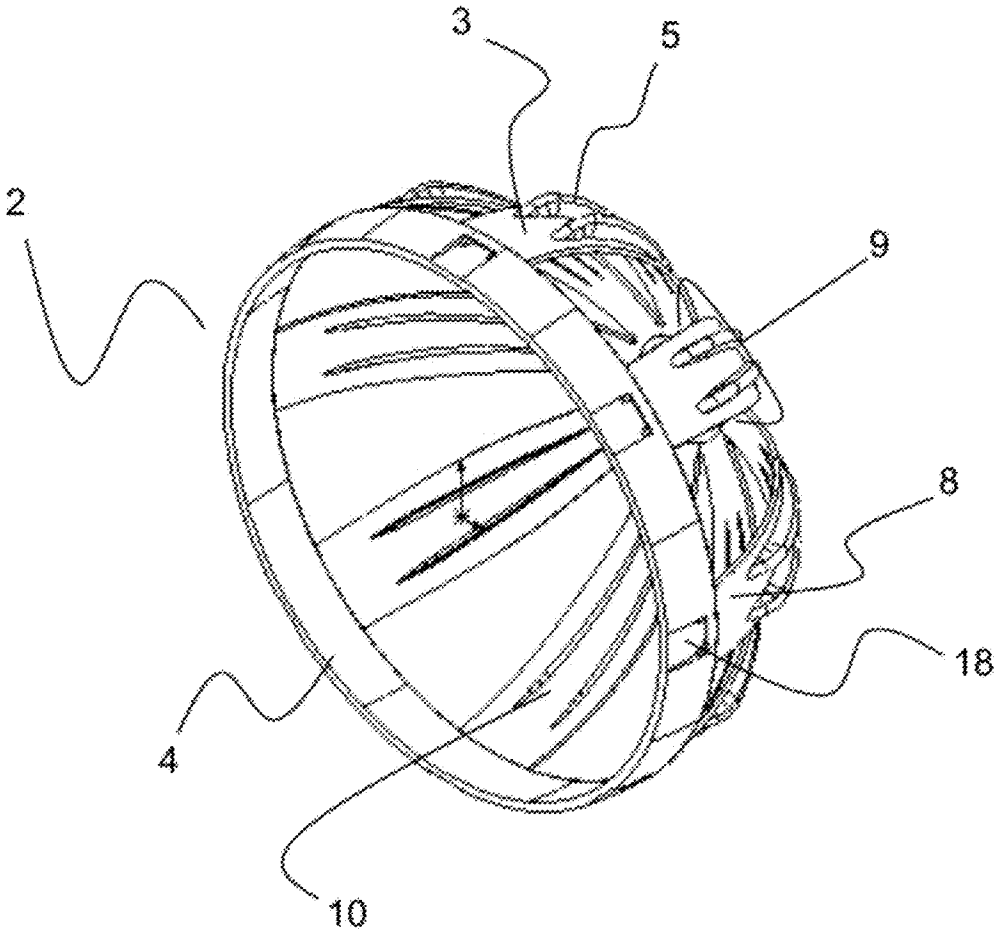
FIG. 18 is an elevational perspective view of a third exemplary embodiment of the exercise device according to the present invention in a fully assembled configuration and as it appears when not applied to a stability ball.
Figure 20:
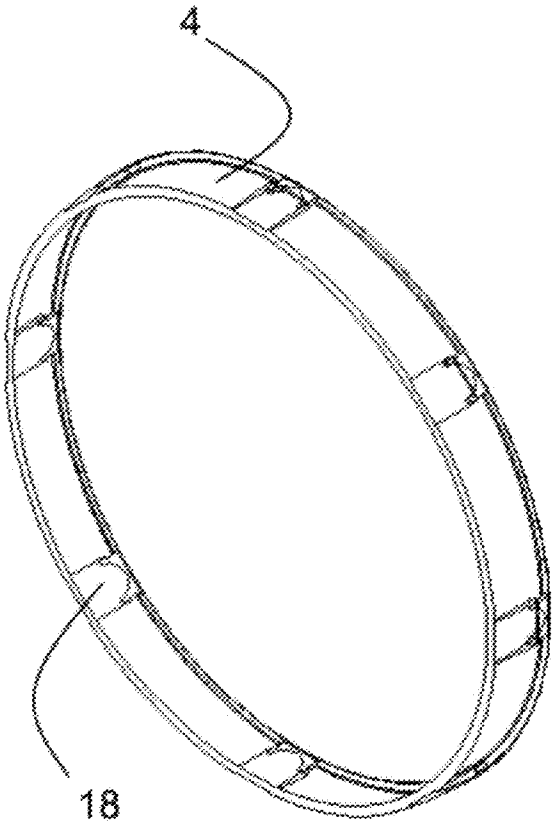
FIG. 20 is an elevational perspective view of the belt of the exercise device of FIG. 18.
Figure 19:
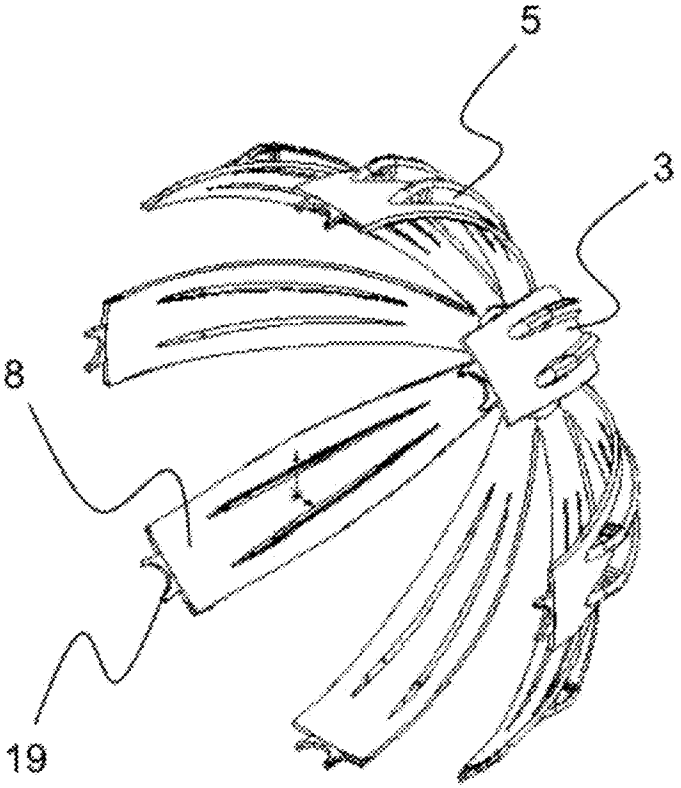
FIG. 19 is an elevational perspective view of the exercise device of FIG. 18, without the belt attached.

The mechanism described above for anchoring or securing the rib assemblies to the belt serves as just one illustration of a large number of mechanisms that are contemplated by the present invention. For example, FIGS. 18 to 20 illustrate a third exemplary embodiment of the exercise device according to the present invention that is very similar to the embodiments of FIGS. 1 to 17 except for the securing mechanism between the ends 8 of the rib assemblies 10 and the belt 4. As shown in detail in FIG. 19, each rib 3 has a U-shaped hook or protrusion 19 at its radiating end 8. As depicted clearly in FIG. 20, to secure the rib 3 to the belt 4, the belt has a corresponding number of U-shaped slots or notches 18 along the length of the belt's circumference that are shaped to matingly fit the U-shaped hooks or protrusions 19 of the ribs 3 when the U-shaped hooks or protrusions 19 are slidingly inserted into the slots 18 of the belt in a buckle-like fashion.

Figure 22:
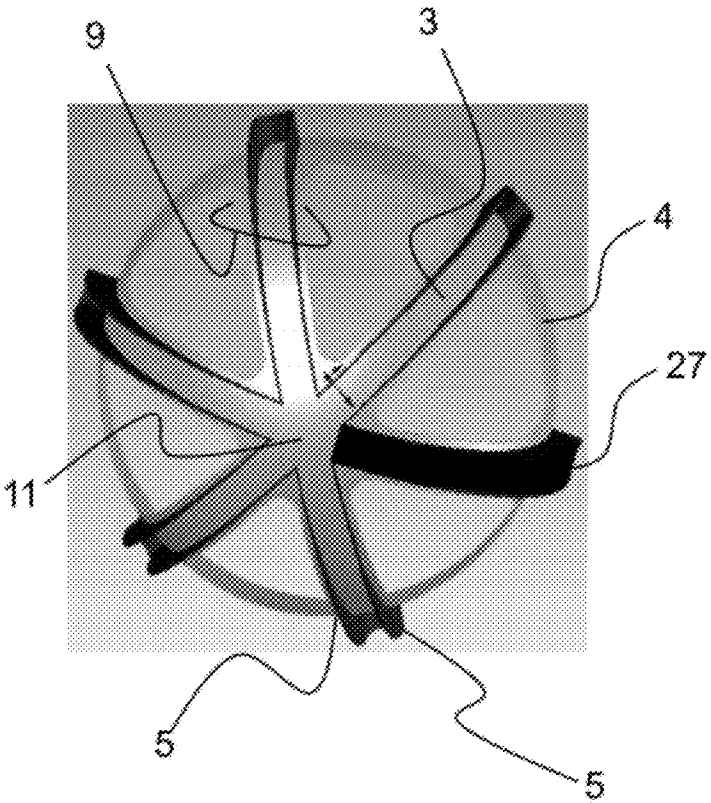
FIG. 22 is a bottom view of the exercise device of FIG. 21 with an alternative embodiment of inclination on one of the ribs.
Figure 21:
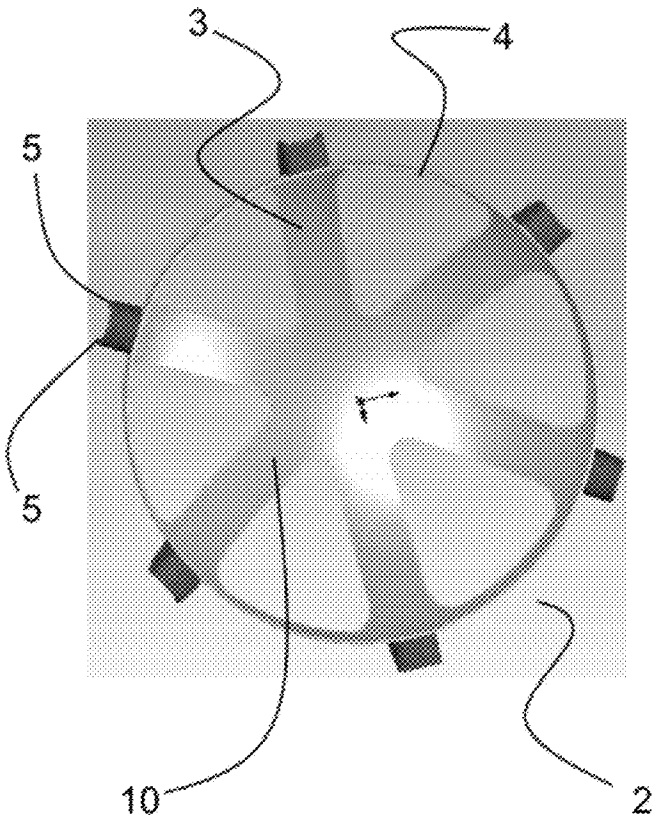
FIG. 21 is a top view of a fourth exemplary embodiment of the exercise device according to the present invention in a fully assembled configuration and as it appears when not applied to a stability ball.
Figure 24:
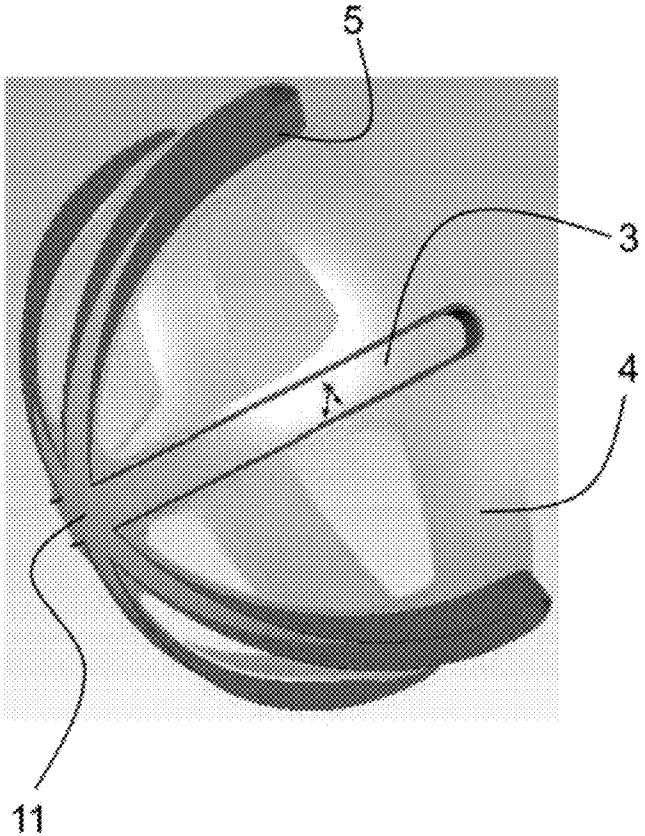
FIG. 24 is a perspective view of the right side of the exercise device of FIG. 21.
Figure 23:
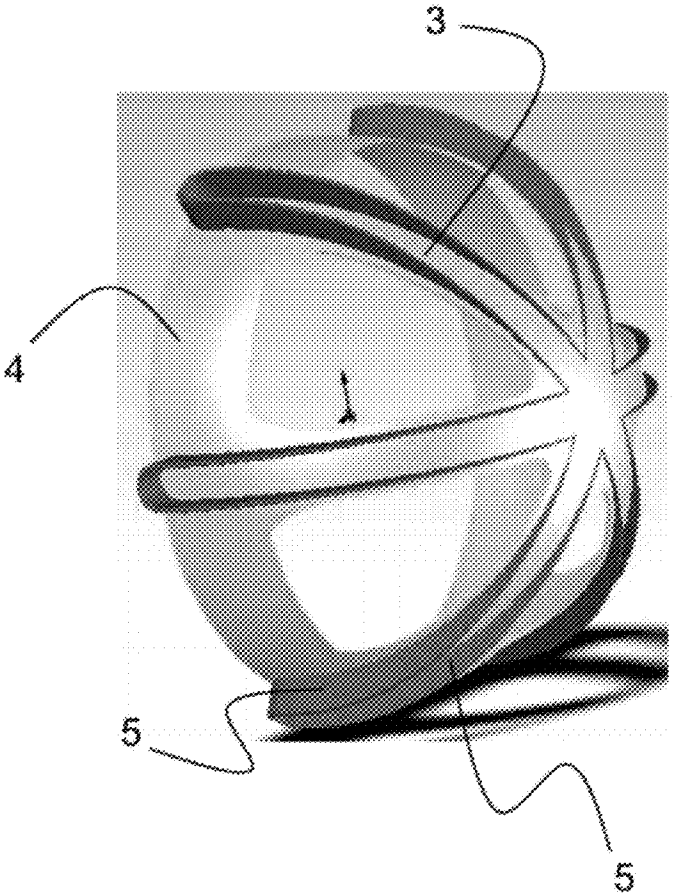
FIG. 23 is a perspective view of the left side of the exercise device of FIG. 21.

Alternatively, it is contemplated by the present invention that any mechanism for anchoring or securing the rib assemblies 10 to the belt 4 may be entirely omitted. For example, FIGS. 21 to 24 illustrate a fourth exemplary embodiment of the exercise device according to the present invention whereby the rib assemblies 10 and the belt 4 are formed as a single integral piece such that the rib assemblies cannot be removed, but are permanently secured to the belt. This type of assembly for the exercise device 2 may be made by, for example, injection-type molding. FIG. 22 illustrates on one rib 3, an alternative embodiment of the inclined planes or wings 5, which are shown as a single inclined wedge or wing 27. Thus, it should be noted that a number of alternative shapes and a variable number of the inclined planes or wings 5 are possible with the invention and include, for example, a single inclined plane 5, a variable number of inclined planes 5, or one or more intermittent inclined tabs for any one or more of the ribs 3.

Figure 32:
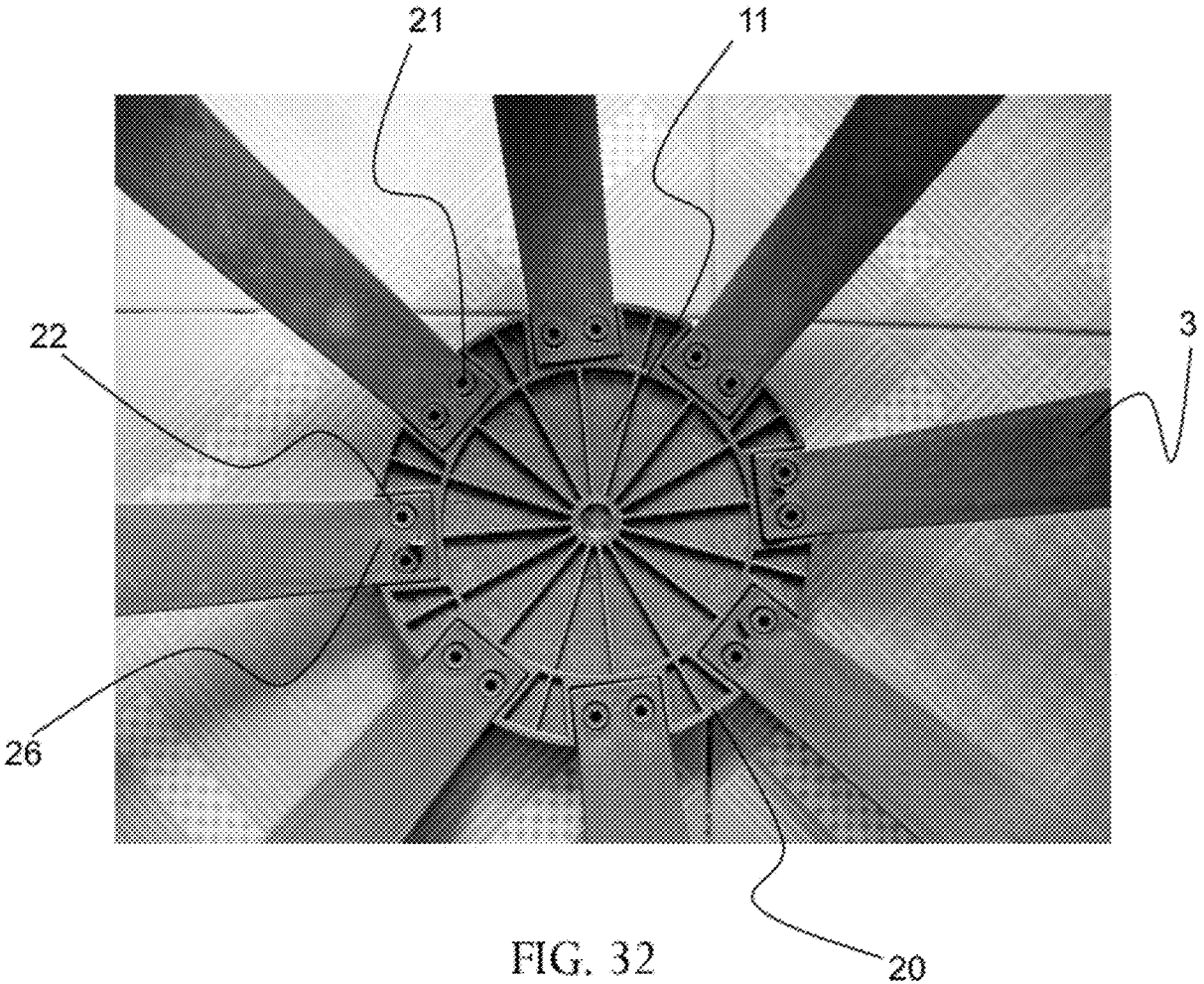
FIG. 32 is a partial, top view of the interior of a fifth exemplary embodiment of the exercise device according to the present invention whereby, shown in detail, are the ribs anchored also at a central hub forming the bottom of the device.
Figure 33:
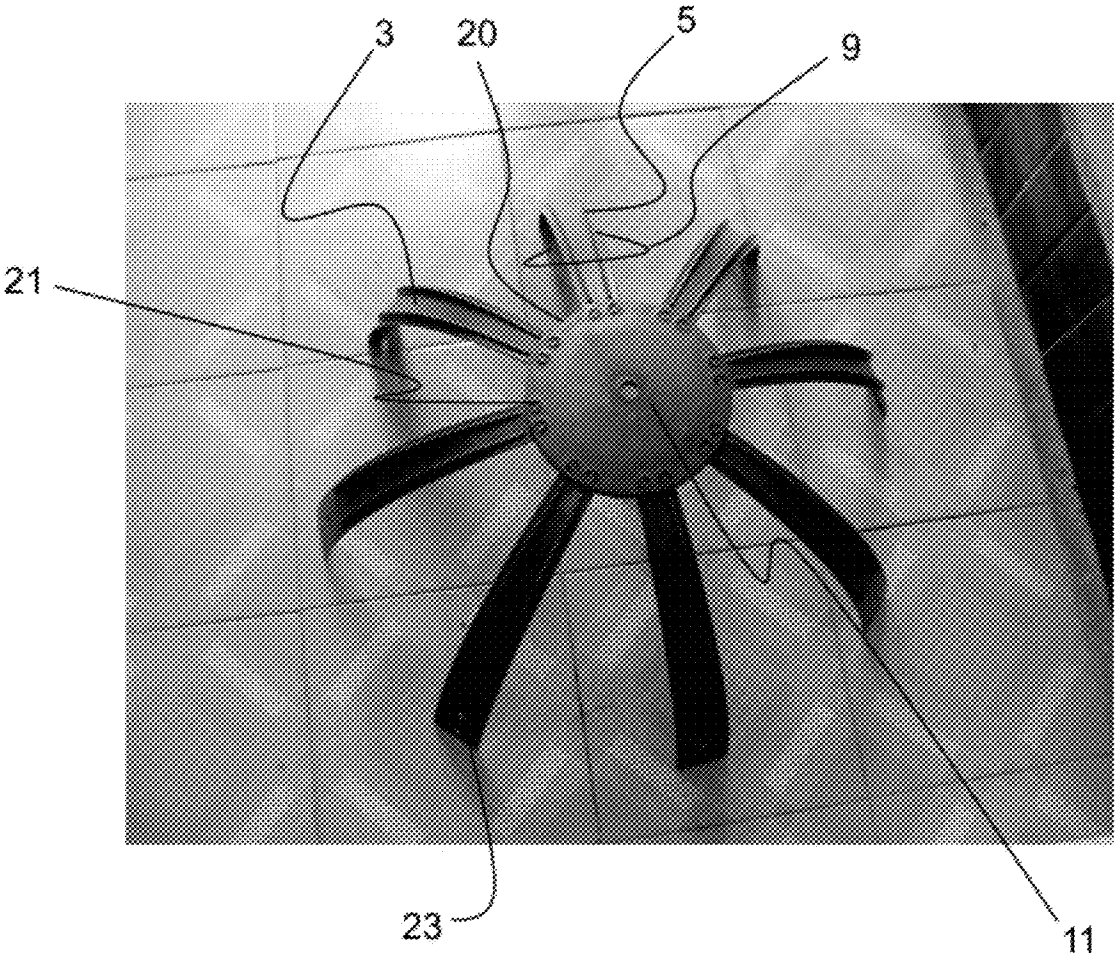
FIG. 33 is a bottom view of the exterior of the exercise device of FIG. 32, without the belt attached.
Figure 34:
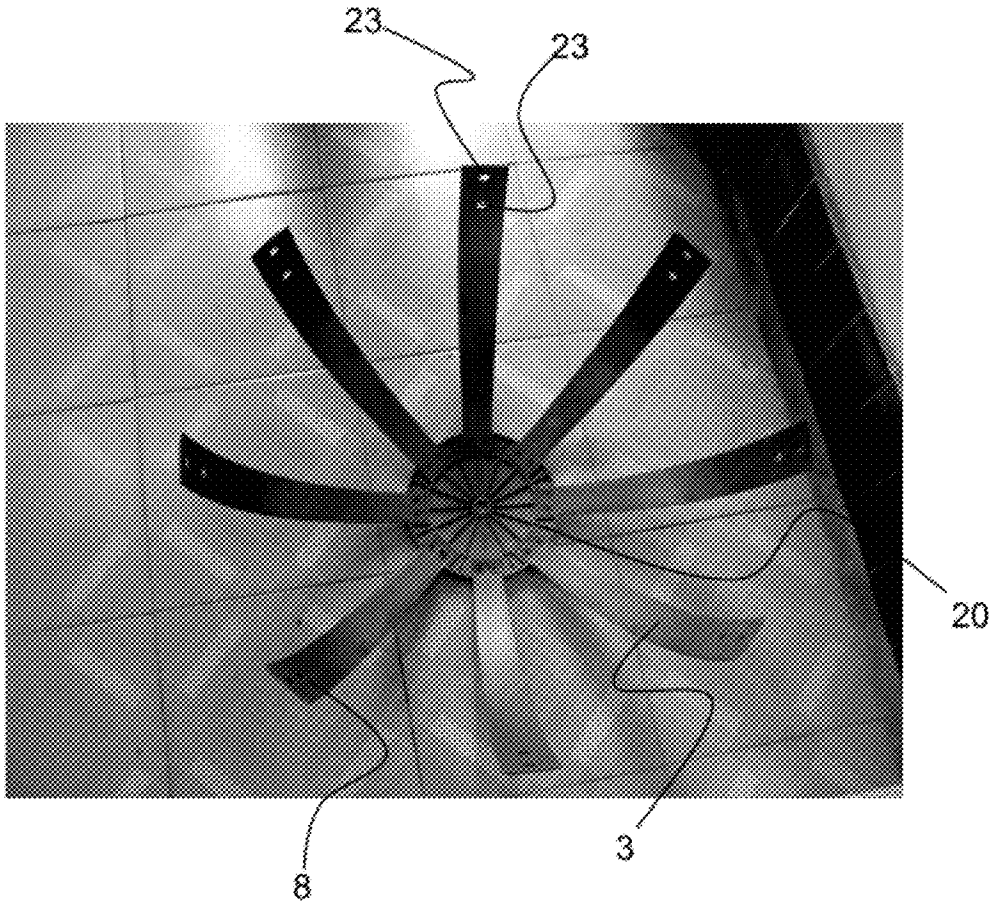
FIG. 34 is a top view of the interior of the exercise device of FIG. 32, without the belt attached.
Figure 35:
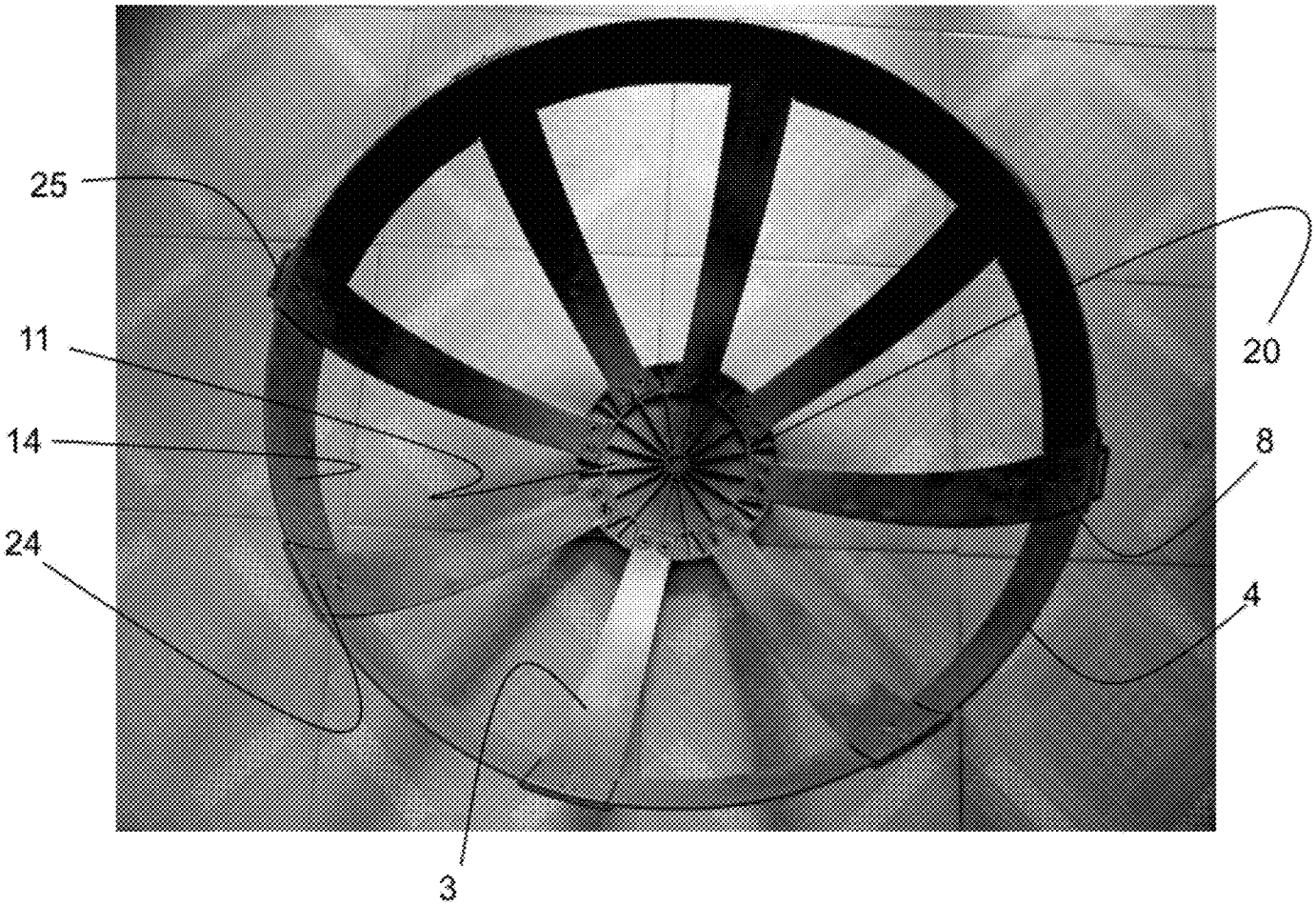
FIG. 35 is a top view of the interior of the exercise device of FIG. 32, in a fully assembled configuration with the belt attached.
Figure 36:
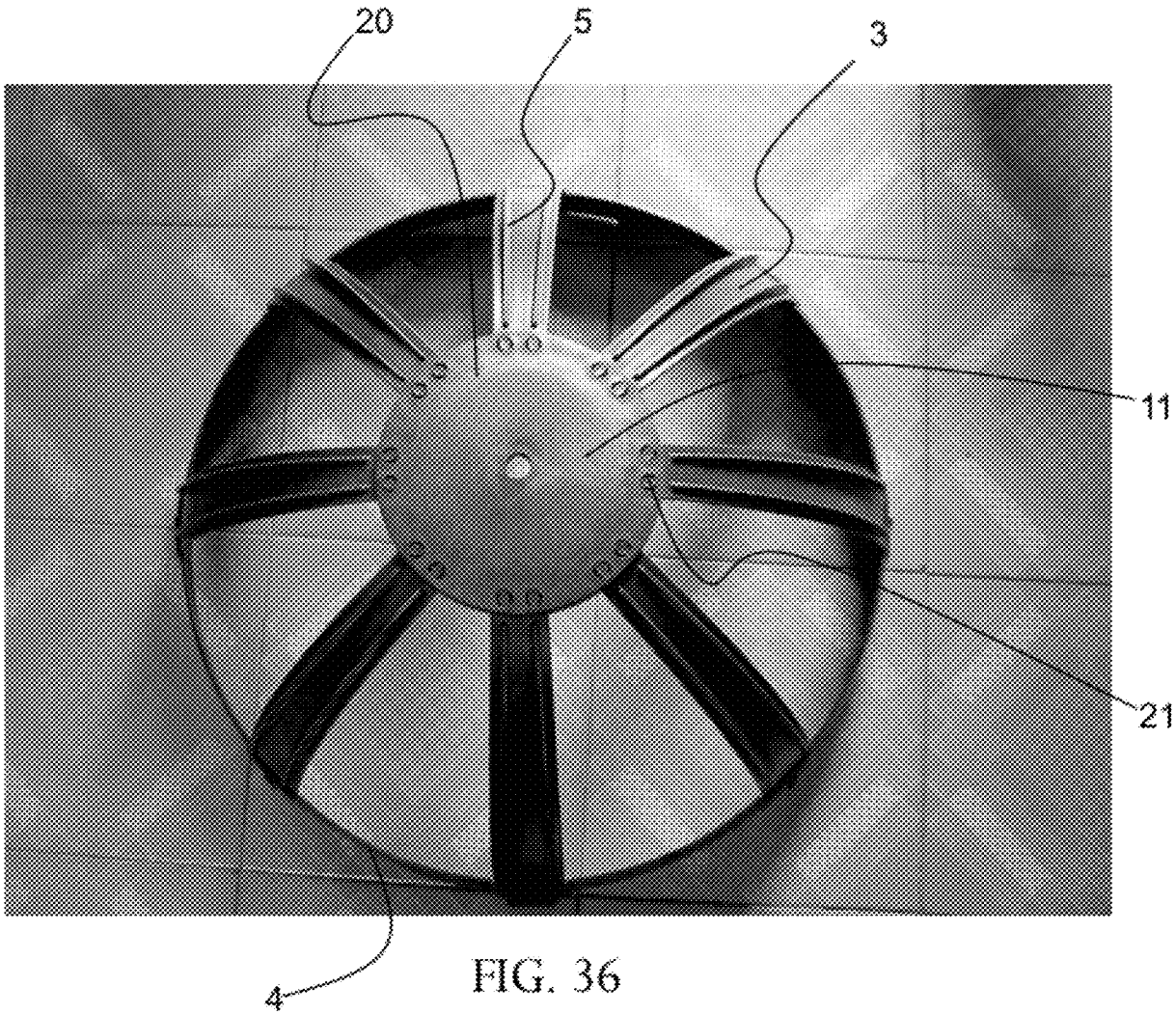
FIG. 36 is a bottom view of the exterior of the exercise device of FIG. 32, in a fully assembled condition with the belt attached.
Figure 37:
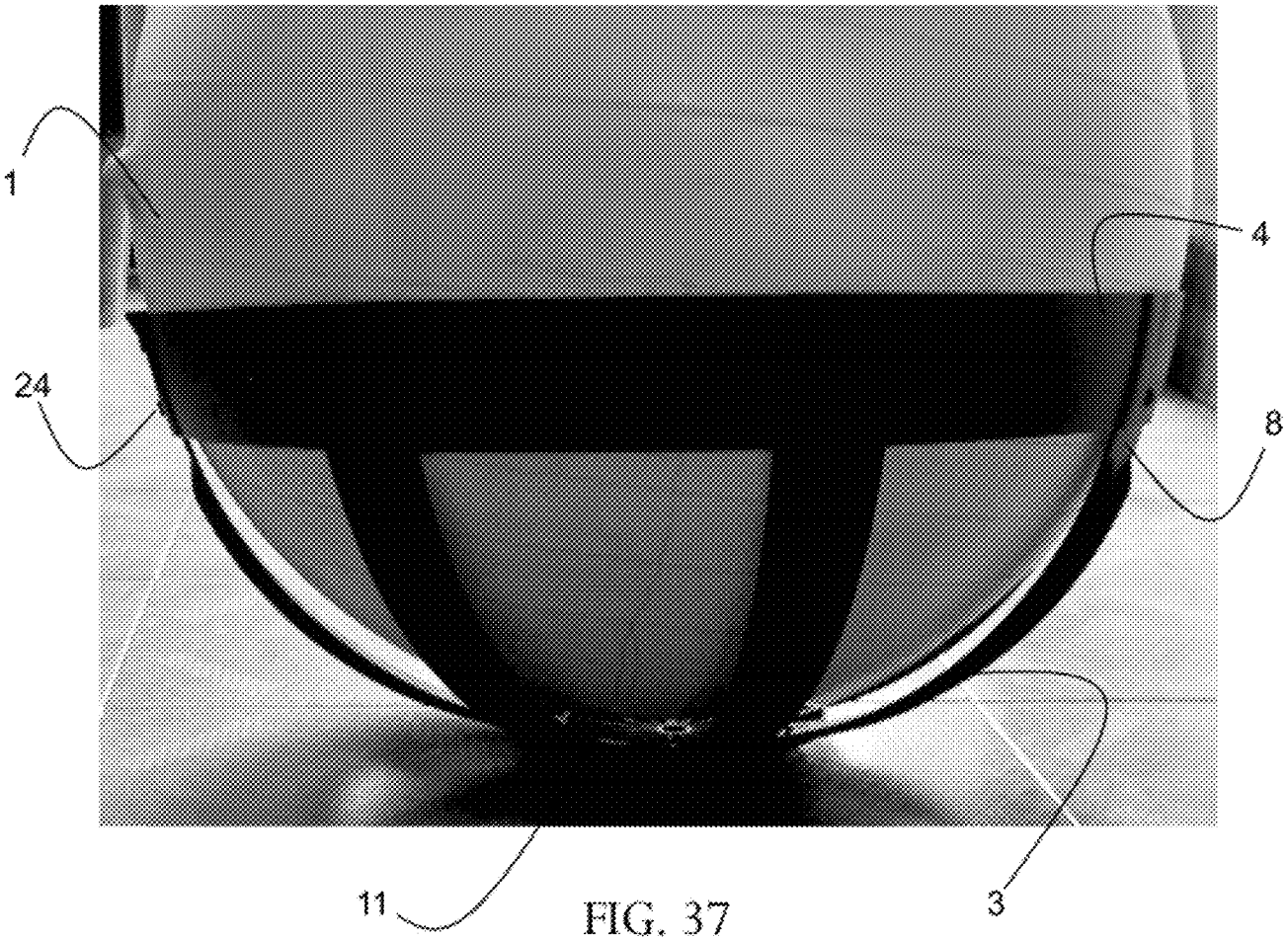
FIG. 37 is a side view of the exercise device of FIG. 32 after its application to a stability ball.
Figure 38:
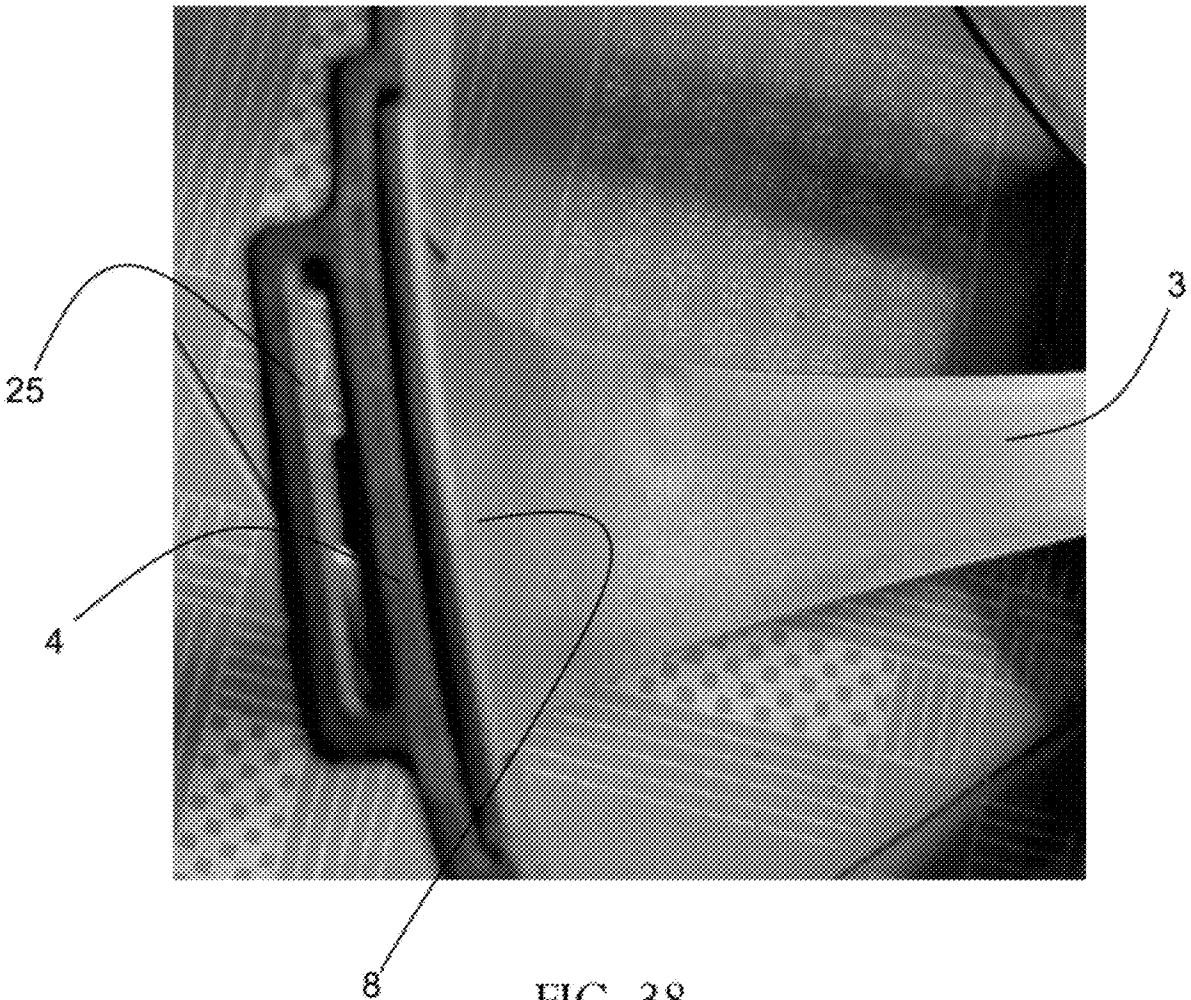
FIG. 38 shows, in close-up detail, a single rib of the exercise device of FIG. 32 at its anchoring point to the belt.
Figure 39:
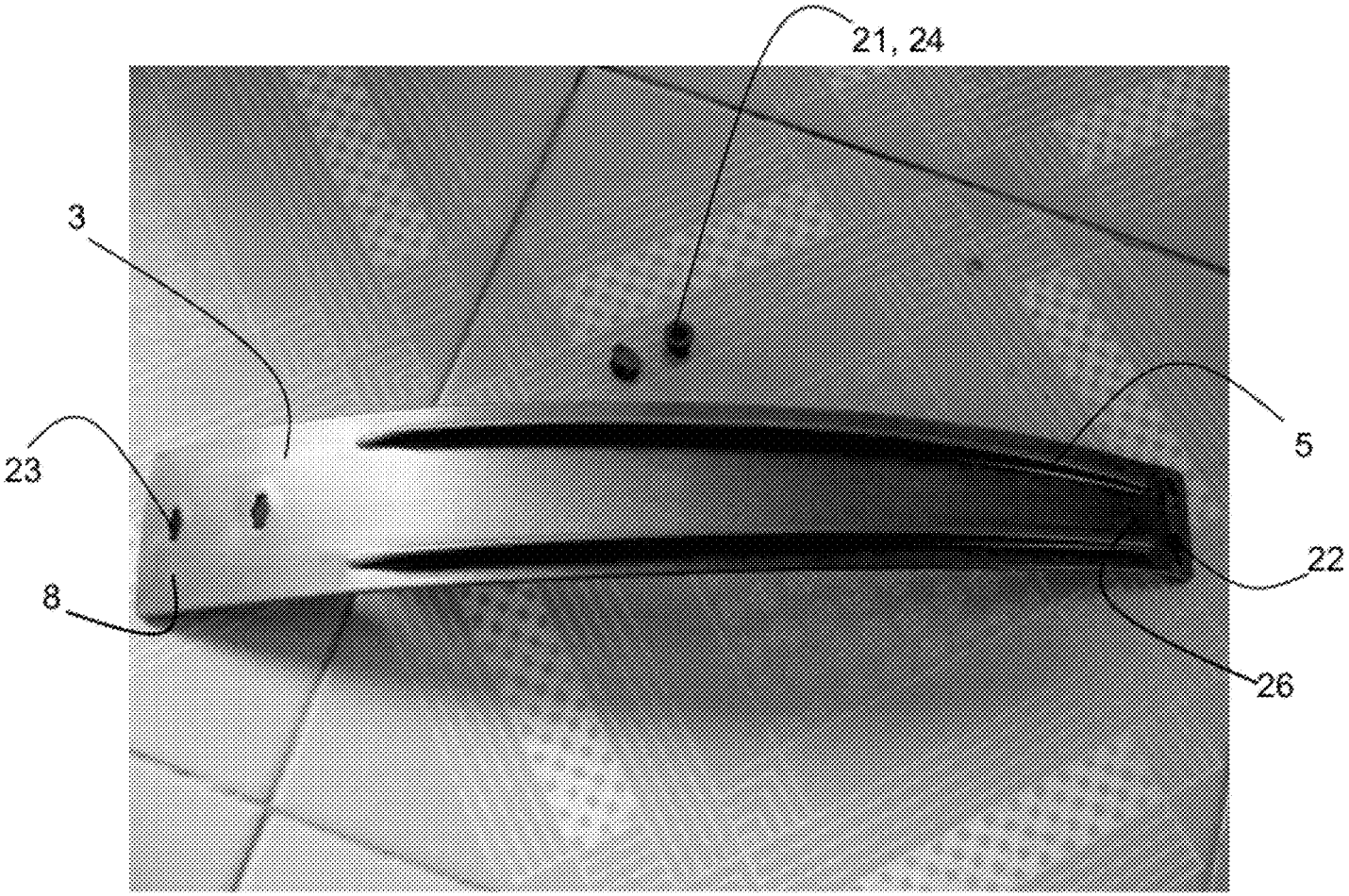
FIG. 39 is an exterior view of a single rib of the exercise device of FIG. 32 having a pair of inclined planes and two mounting holes at each end for anchoring the rib to the central hub and the belt.
Figure 40:
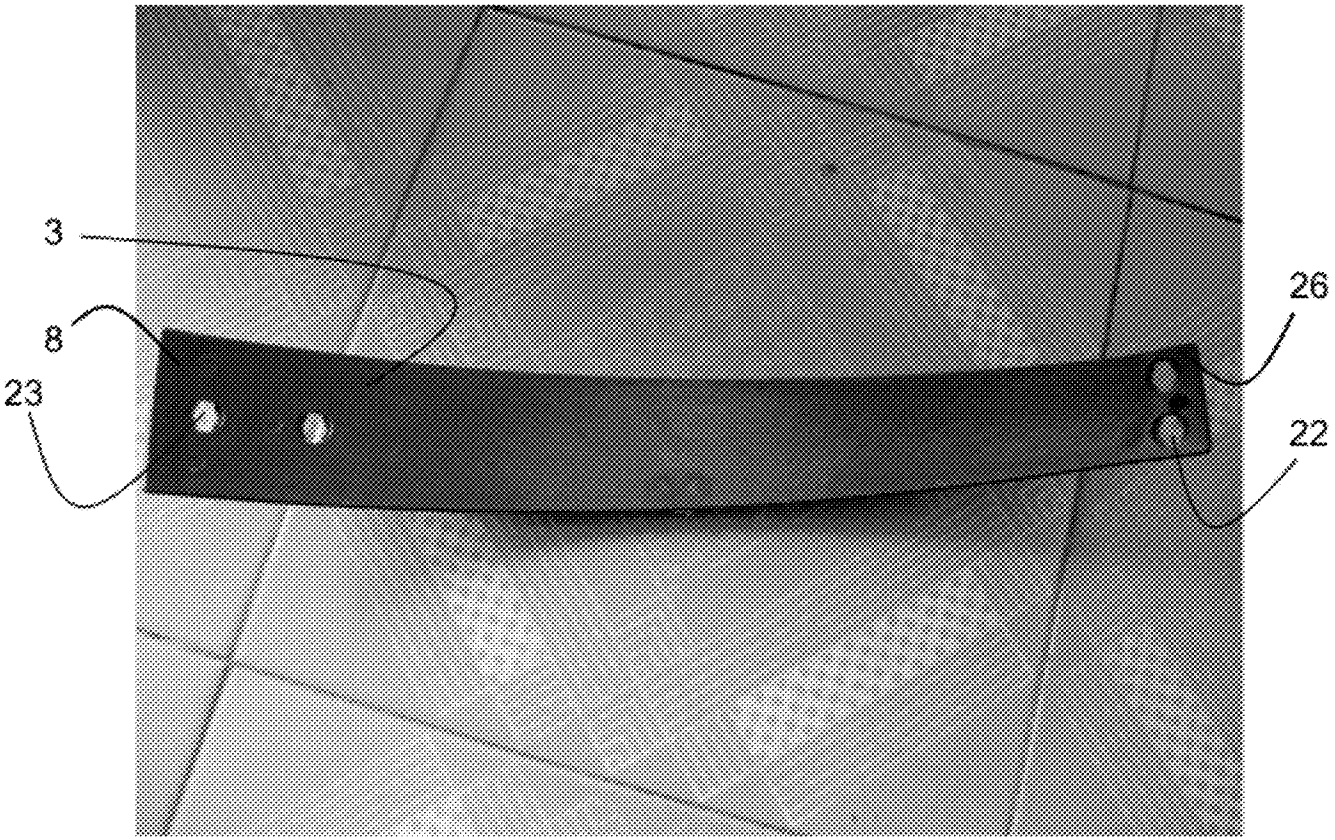
FIG. 40 is an interior view of a single rib of the exercise device of FIG. 32.
Figure 41:
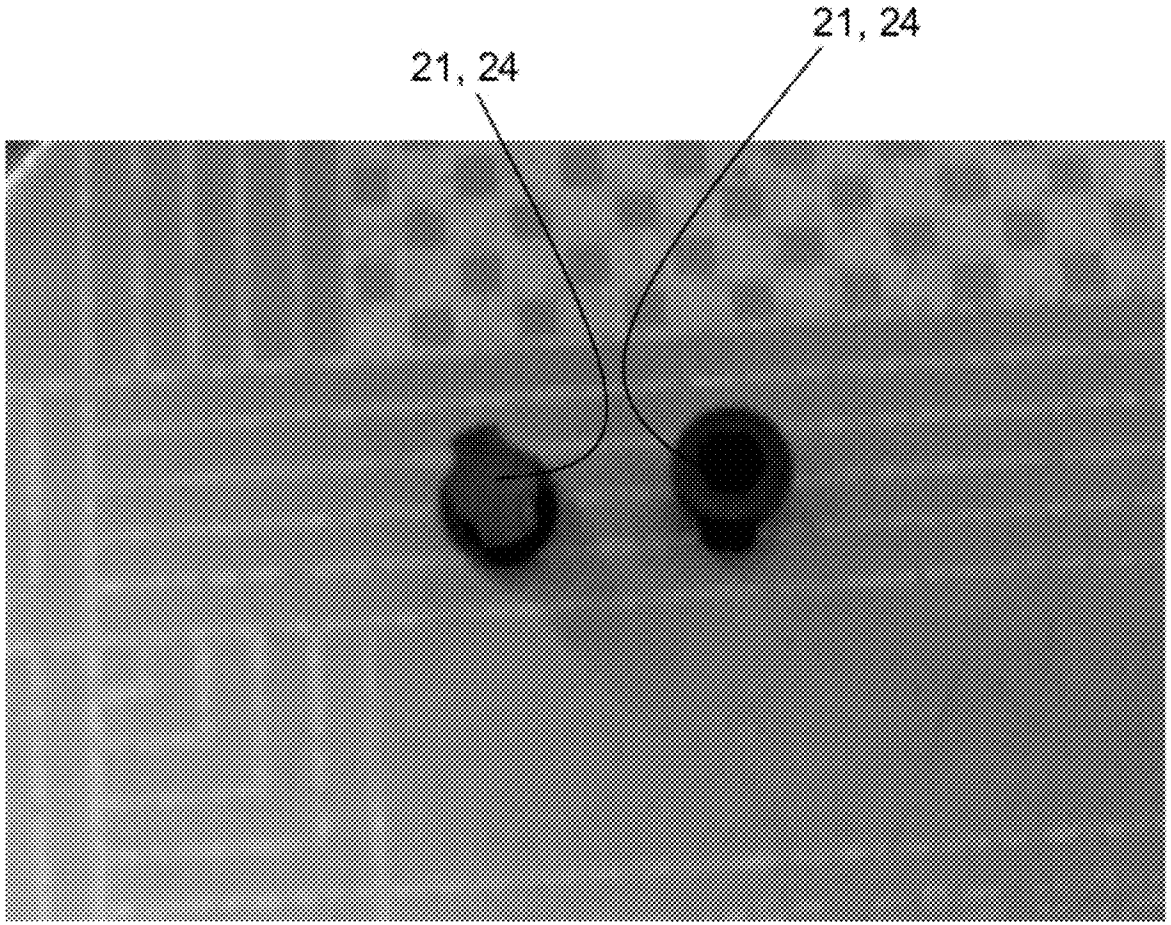
FIG. 41 shows two locking pins for anchoring the ribs of the exercise device of FIG. 32 to the central hub and the belt, whereby the locking pins are accommodated by the mounting holes of the ribs and corresponding mounting holes of the central hub and belt.

In FIGS. 32 to 40, there is shown a fifth exemplary embodiment of the exercise device according to the present invention, which differs from the previously described embodiments in that the plurality of rib assemblies 10 are cut in half into their constituent ribs 3, and a central hub 20 is used to interconnect the ribs 3 at the ends 26 of the ribs that are proximate the central base 11. By dividing the rib assemblies into their constituent ribs 3 and incorporating the central hub 20, the central base 11 of the device 2 is no longer formed by the overlapping rib assemblies 10, and thereby provides a smooth rolling surface. Instead, both ends 8, 26 of the ribs 3 are now removably secured to the belt 4 or the central hub 20, respectively. For example, as shown in close detail in FIGS. 39 and 40, the narrower end 26 of the rib 3 that is proximate to the central hub 20 when assembled, has two adjacent, vertically-aligned mounting holes 22. At the wider, radiating end 8 of the rib 3 that is proximate to the belt 4 when assembled, there are two adjacent, horizontally-aligned mounting holes 23. As best shown in FIGS. 32 and 36, to secure the ribs 3 to the central hub 20, two locking pins 21 (shown in detail in FIG. 41) are inserted into mounting holes 22 and through corresponding, recessed holes along the outer circumference of the central hub 20 to securely attach the two pieces together. The locking pin may be of any suitable type, such as an Allen-type pin. Similarly, as best shown in FIG. 35, to secure the ribs 3 to the belt 4, two locking pins 24 are inserted into mounting holes 23 and through corresponding, recessed holes along the circumferential length of the belt 4 from the interior surface or side 14 of the belt. The resulting device 2, in a fully assembled configuration, is shown in FIG. 37. In this exemplary embodiment of FIGS. 32 to 40, the central hub 20 is annular in shape, but has a surface area that closely approximates a solid, circular plate. However, the central hub 20 can be of any shape or form that acts as a central meeting place for the ribs 3 and sufficiently conforms to the circumference of the stability ball 1 seated therein such that the stability ball has a base, resting position, but is also capable of being rolled during exercise. For example, despite the nearly plate-like shape, the central hub 20 of the embodiment shown in FIGS. 32 to 40 has an opening at its center (thereby, forming an annulus) and a slight concavity that permits it to roll along a surface during exercise, but still maintains a default base, or resting position for the stability ball 1 when the ball is seated inside the device 2.

Brackets 25 are molded onto the belt 4 at two points on the circumference of the exercise device that are 180 degrees apart. These brackets 25 are used to attach resistance tubes to the device, for example, using nylon belts with D-rings so that resistance-training exercises can be performed on the ball.

Figure 42:
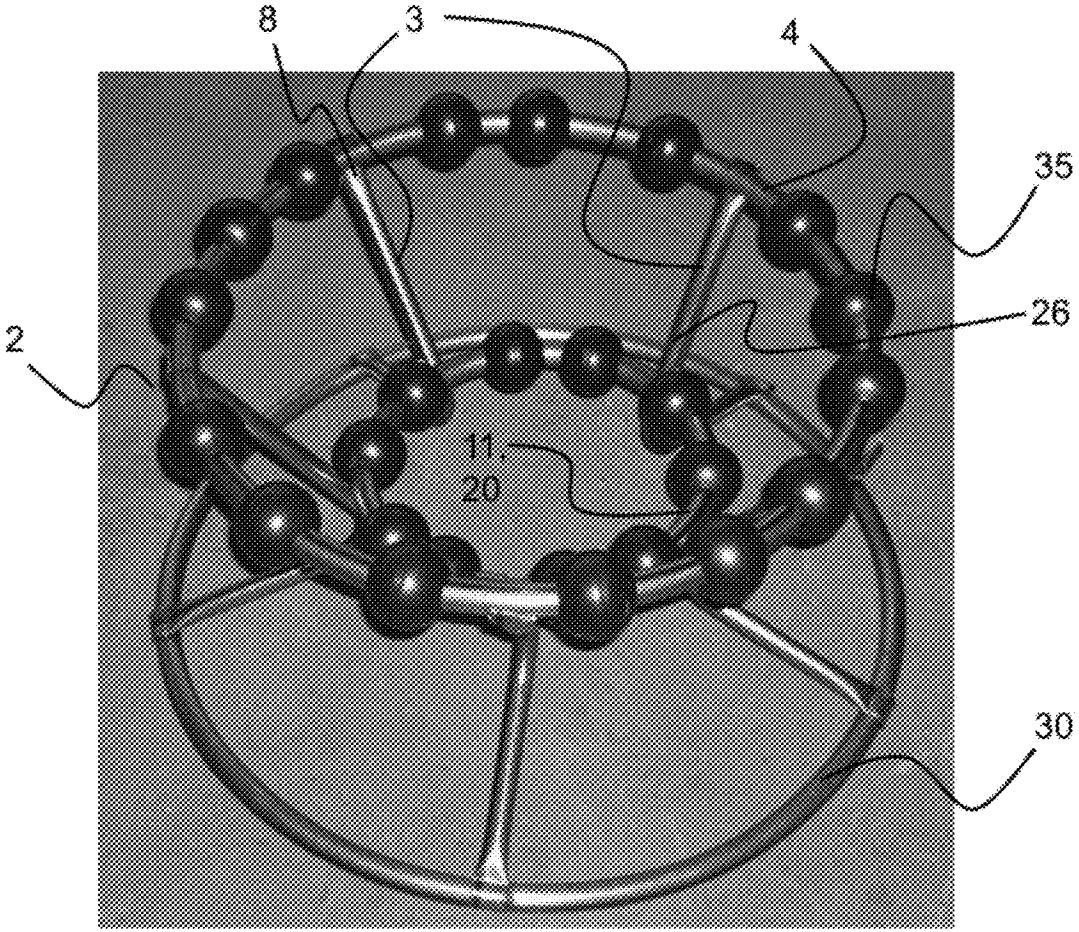
FIG. 42 is a perspective view of a sixth exemplary embodiment of the exercise device according to the present invention in a fully assembled configuration, as it appears when not applied to a stability ball.
Figure 43:
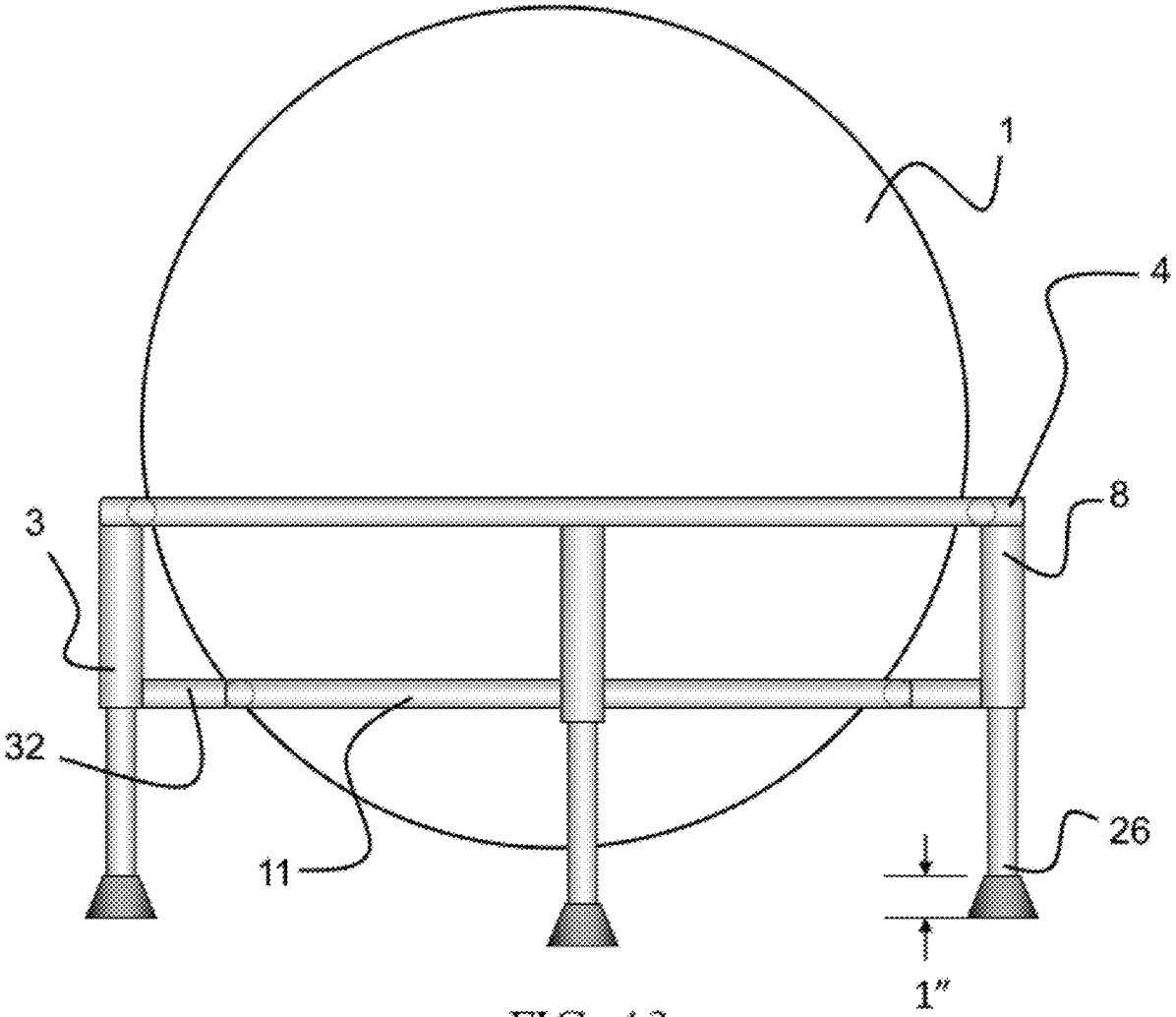
FIG. 43 is a side elevational view of a seventh exemplary embodiment of the exercise device according to the present invention in a fully assembled configuration and after its application to a stability ball.

In FIG. 42, there is shown a sixth exemplary embodiment of the exercise device according to the present invention. This sixth embodiment differs in a number of respects from the previously described embodiments. For example, in this embodiment, the central hub 20 is in the shape of an annular ring that encircles and seats the lower circumference of the ball 1 and leaves a substantial part of the bottommost portion of the ball exposed and uncovered by the central hub 20. The plurality of ribs 3 are held at equidistant points from one another in-between the central hub 20 and the belt 4. Together, the central hub 20, belt 4 and ribs 3 form a cage in which the ball 1 is seated. In addition, a secondary pedestal structure 30 is applied to the central hub 11 to create a stand for holding the exercise device 2 stationary when placed on a substantially flat surface. When viewing the overall assembly of the device 2 and the secondary structure 30 together, its appearance resembles an hourglass shape. Due to the fact that the secondary structure 30 prevents the exercise device 2 from moving, one or more rollers 35 are molded onto or otherwise secured around at least one of the central hub 20 and belt 4 to allow the ball to still move within the exercise device 2 for use in performing an exercise. Thus, the user is still able to take advantage of the increased resistance that results from placing the ball 1 inside the exercise device 2. Due to their construction, the rollers 35 rotate about the tubular bars that form the central hub 20 and the belt 4 when brushed upwards or downwards by the ball's movement. Accordingly, the ball 1 is still able to move within the stationary exercise device 2.

In a similar manner to that shown in the embodiments of FIGS. 32 to 40 and 42, it is contemplated to be within the spirit and scope of the present invention that in any of the foregoing embodiments, the central base 11 may be in the form of an annulus and/or an annular ring that interconnects or is formed by the plurality of rib assemblies 10, rather than forming a substantially circular and/or solid hub, point, plate or base.

Figure 44:
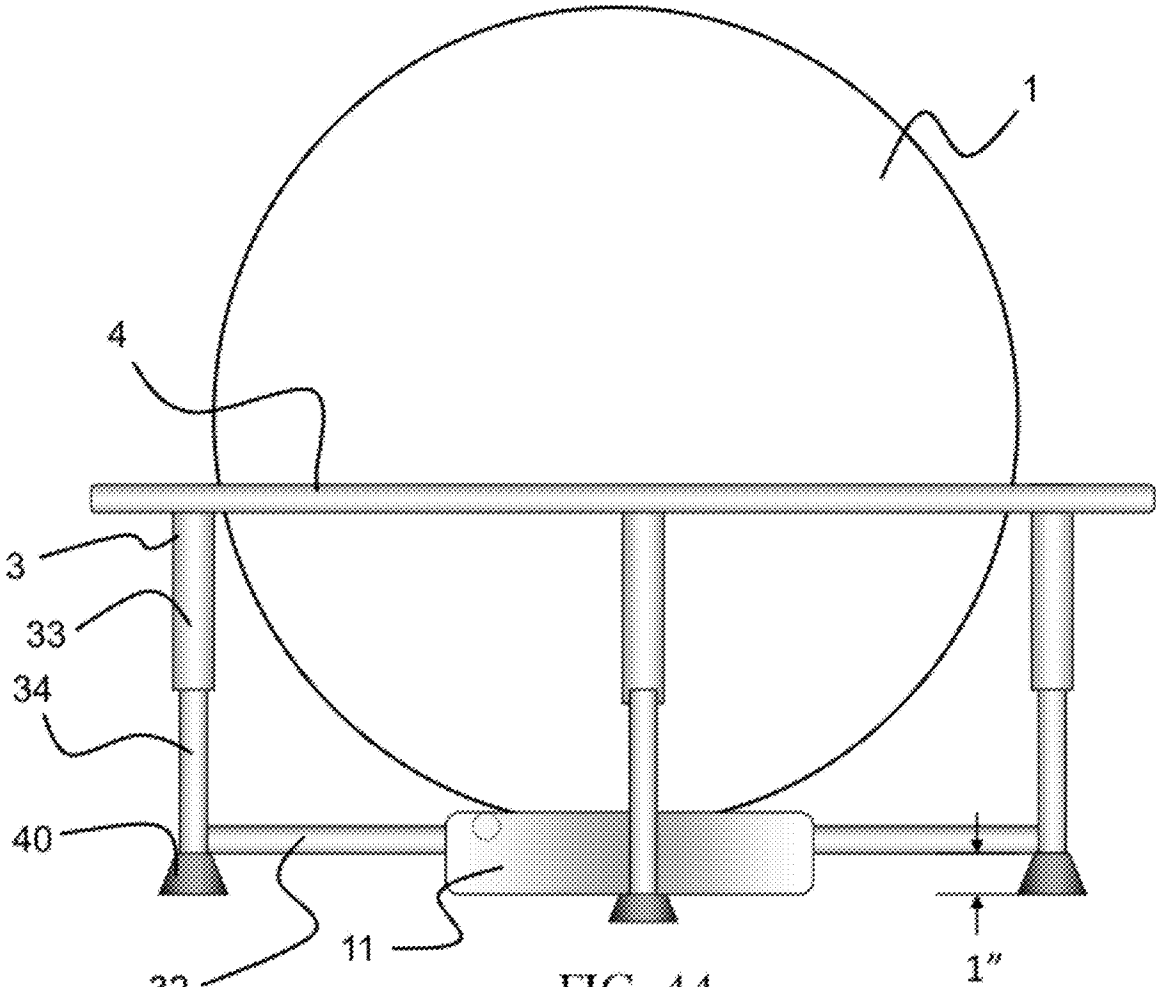
FIG. 44 is a side elevational view of an eighth exemplary embodiment of the exercise device according to the present invention in a fully assembled configuration and after its application to a stability ball.
Figure 45:
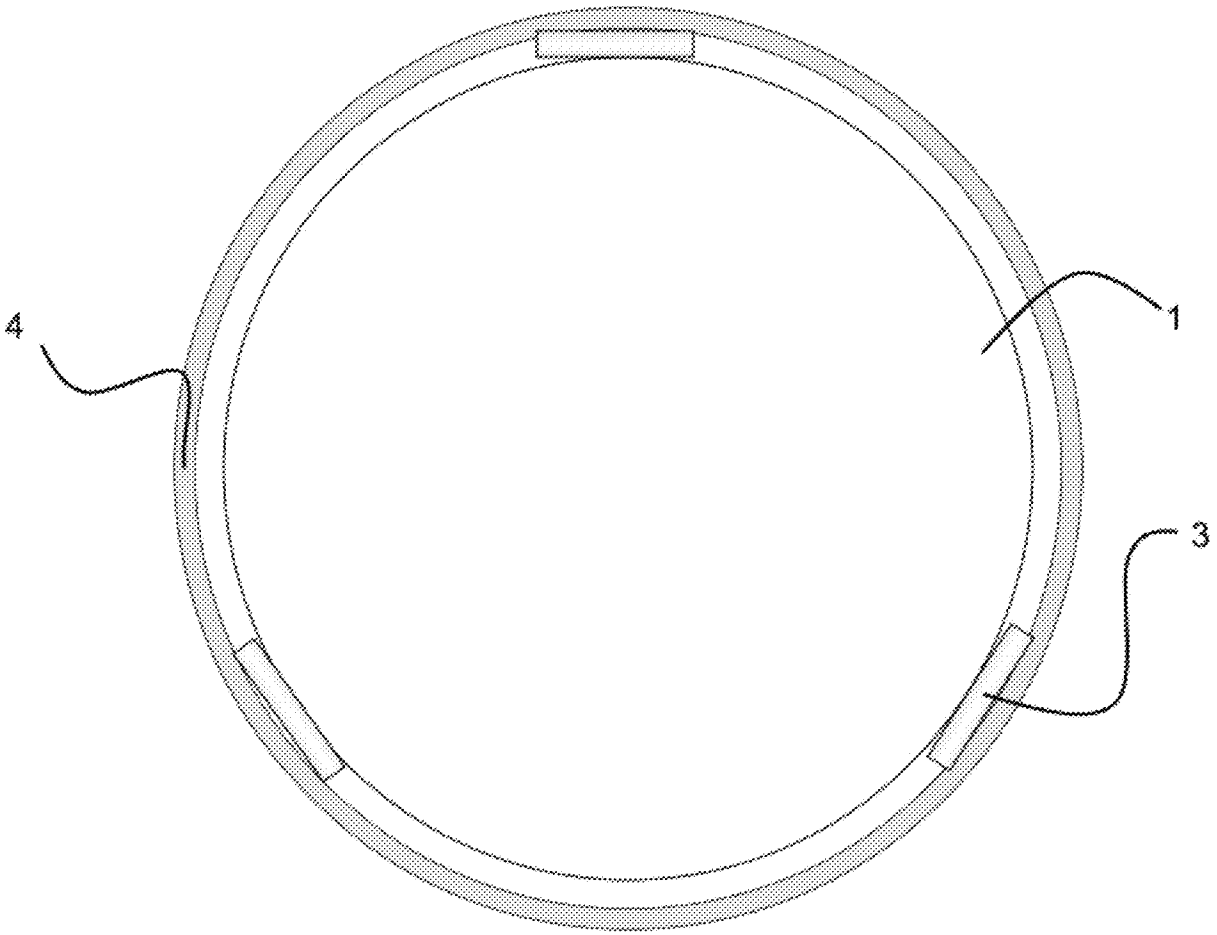
FIG. 45 is a top plan view of the exercise device of FIGS. 43 and 44.
Figure 46:
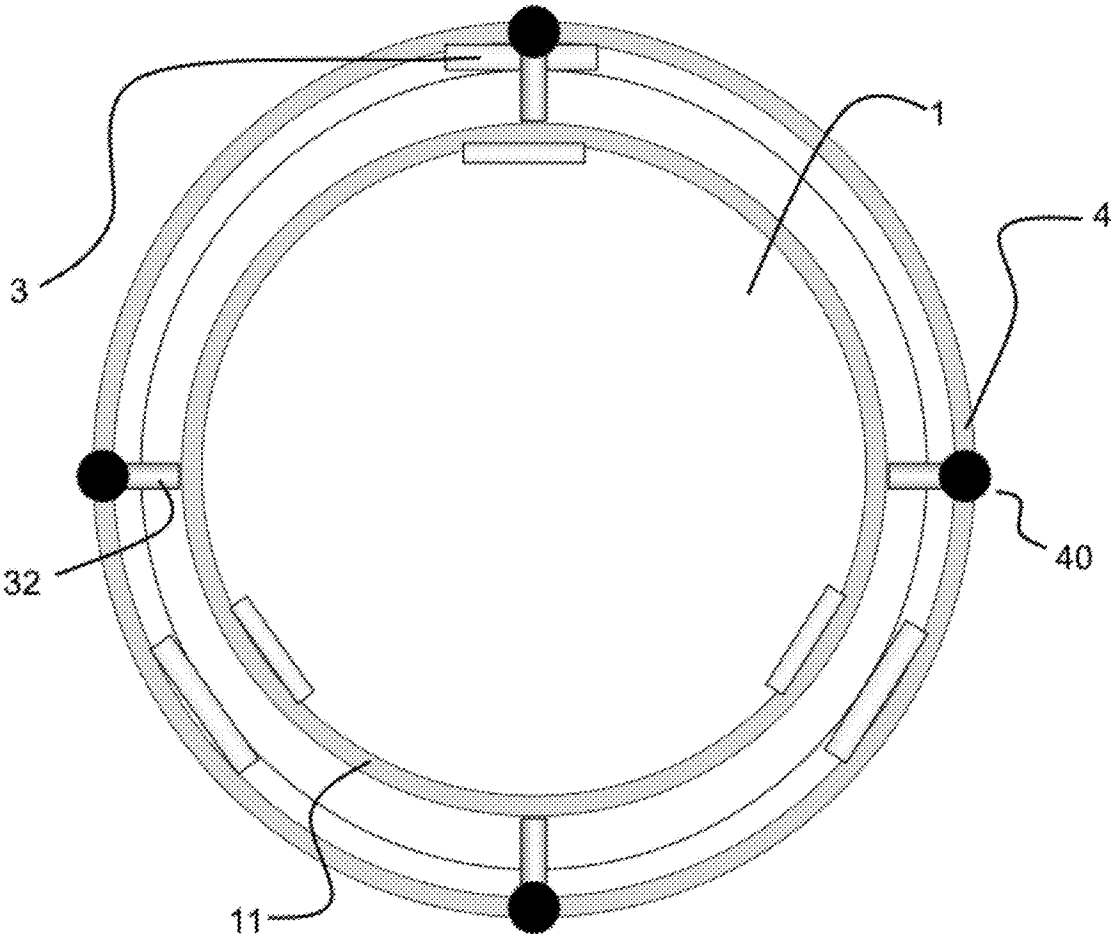
FIG. 46 is a bottom plan view of the exercise device of FIGS. 43 and 44.
Figure 48:
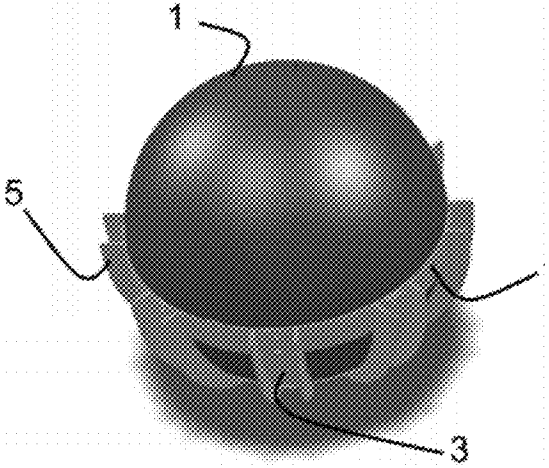
FIG. 48 is a perspective view of the topside of the exercise device of FIG. 47.
Figure 47:
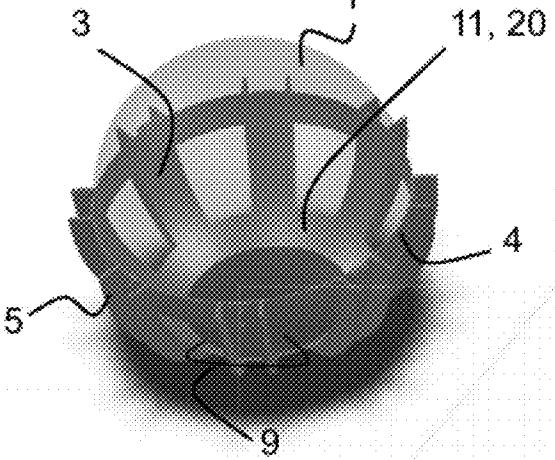
FIG. 47 is a perspective view of the topside of a ninth exemplary embodiment of the exercise device according to the present invention in a fully assembled configuration and after its application to a stability ball, as well as the interior of the device made visible by the translucency of the stability ball.

FIGS. 43 to 46 illustrate a seventh and an eighth embodiment of the exercise device according to the present invention Like the embodiment shown in FIG. 42, an annular ring forms the central base 11 and is positioned along the lower circumference of the exercise device 2. In the exemplary embodiment of FIG. 43, the central base 11 is placed closer to the belt 4 in comparison to the position of the central base 11 that is shown in the embodiment of FIG. 44. In the exemplary embodiment of FIG. 44, the central base 11 is placed at a much lower point (e.g., approximately 1" inch from the bottommost point of the exercise device 2) along the lower circumference of the exercise device 2. These two embodiments differ from the embodiment of FIG. 42 in that the plurality of ribs 3 do not radiate outwards to form a hemispherical cage with the central base 11 and the belt 4. By contrast, the ribs 3 extend vertically straight downwards from the belt 4 to the surface upon which the exercise device 2 rests. For example, if the exercise device 2 is resting on a horizontally flat floor, the ribs 3 extend from the belt 4 to the floor such that they are substantially perpendicular to the floor plane. As a result, each rib 3 does not directly meet with the central base 11 as the central base 11 necessarily has a smaller diameter than the belt 4. Rather, the ribs 3 act as stilts that hold the exercise device 2 still when it is placed on a substantially flat surface. Each rib 3 is indirectly connected to the central base 11 by an intermediate, interconnecting structure 32 at some point along the length of rib 3. Feet 40, made of rubber or some other suitable high-friction material, may be applied to the free ends of the ribs 3 to aid in stabilizing the exercise device 2 along the surface upon which it rests. In addition, each individual rib 3 may be made to be mechanically adjustable such that its vertical length can be adjusted (i.e., shortened or lengthened). This allows the ribs 3 to accommodate the relative position (height) of the central base 11 and/or any angle present in the surface upon which the exercise device 2 is resting. For example, each individual rib 3 may be comprised of two telescoping pieces 33, 34 that may be adjustably slid within one another to change the combined, overall length of the pieces 33, 34. Accordingly, the ribs 3 are able to maintain a substantially vertical stance along the entire circumference of the exercise device 2 despite any variations in the surface upon which it stands.

Figure 49:
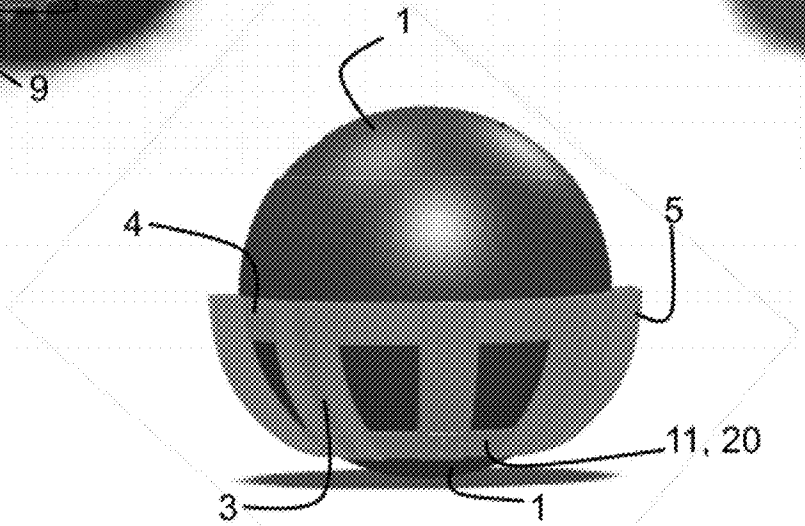
FIG. 49 is a side perspective view of the exercise device of FIGS. 47 and 48.
Figure 51:
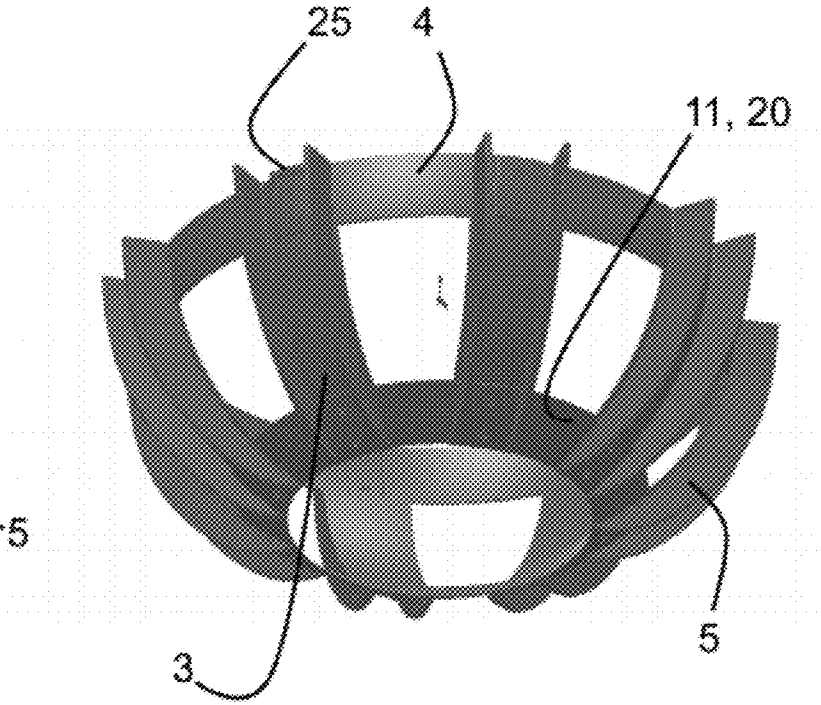
FIG. 51 is a perspective view of the underside of the exercise device of FIG. 50.
Figure 50:
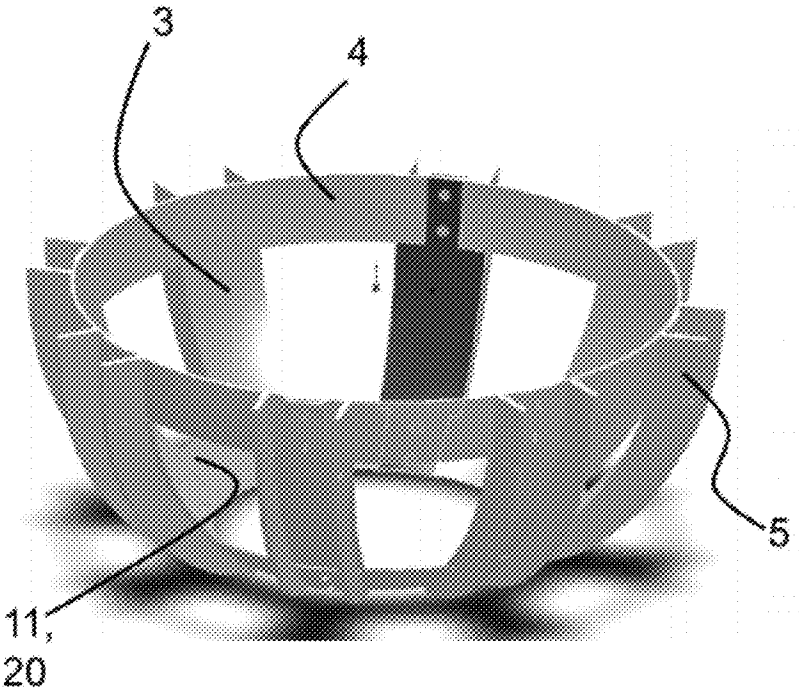
FIG. 50 is a perspective view of the topside of the exercise device of FIGS. 47 to 49, in a fully assembled configuration and as it appears when not applied to a stability ball.
Figure 53:
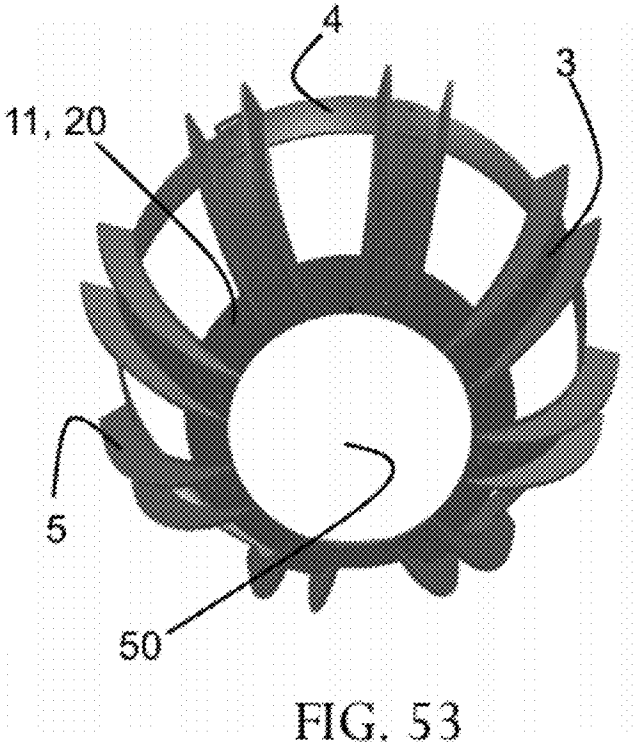
FIG. 53 is a bottom perspective view of the exterior of the exercise device of FIGS. 50 to 52.
Figure 52:
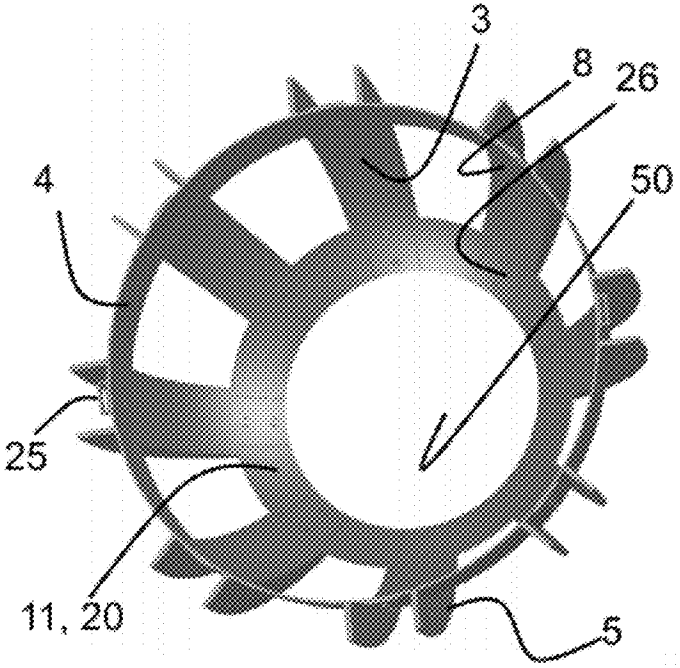
FIG. 52 is a top perspective view of the interior of the exercise device of FIGS. 50 to 51.
Figure 54:
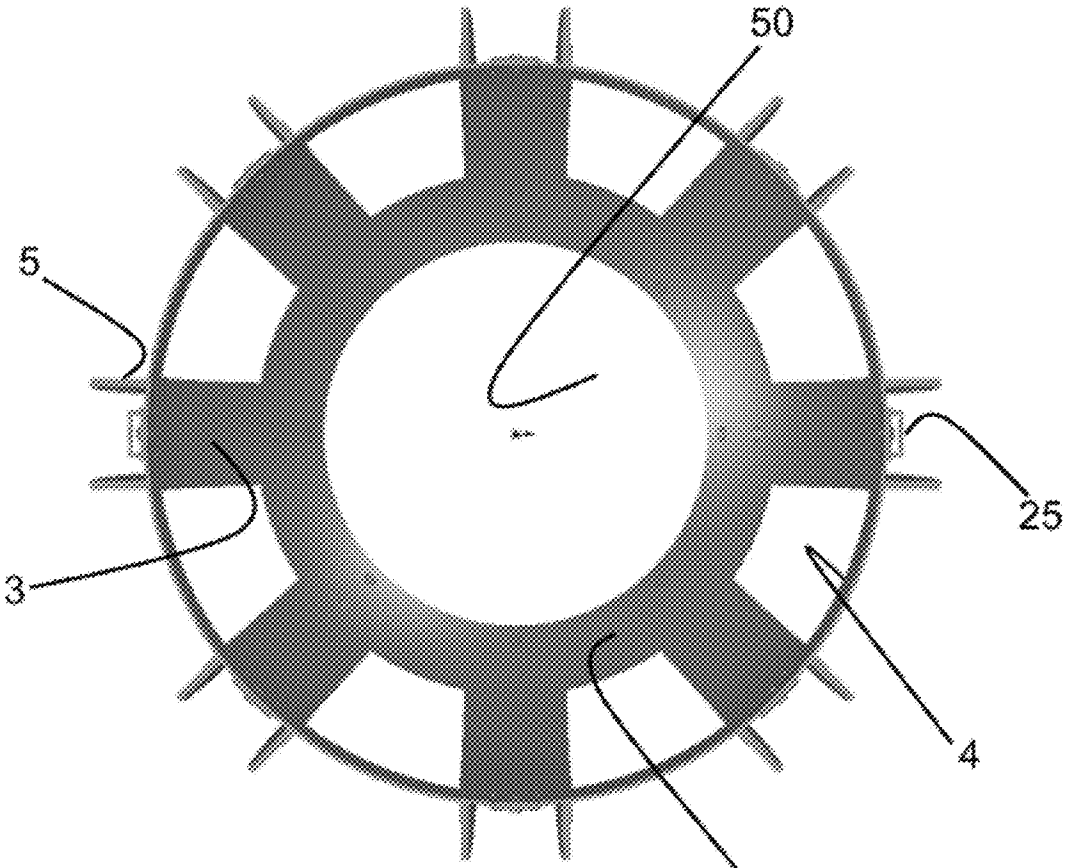
FIG. 54 is a top plan view of the exercise device of FIGS. 50 to 53.

Referring to FIGS. 47 to 54, there is shown a ninth exemplary embodiment of the exercise device according to the present invention. This particular embodiment is substantially similar to the embodiment of FIGS. 32 to 40 in that each rib 3 is removably attached to a central hub 20 at one end 26, and is removably attached to a belt 4 at its opposite (radiating) end 8 to form a hemispherical cage for receiving the lower circumference of the stability ball 1. Alternatively, the ribs 3, the central hub 20, and the belt 4 may be comprised of a single, molded piece such that ribs 3 are integral with the central hub 20 and belt 4. Unlike the embodiment of FIGS. 32 to 40, the central hub 20 is in the shape of an annular ring such that the bottommost portion of the ball 1 is left exposed and uncovered by the large opening 50 of the central hub 20 (as best shown in FIG. 49). As a result, the surface area of the central hub 20 is minimal and therefore, does not significantly impede the rolling movement of the ball. In this way, the ball 1 directly touches the rolling surface making it possible for the user to roll the ball during exercise. The advantageous resistance that counteracts the rolling movement of the ball is still felt by the user, but is primarily created by and concentrated at the inclined planes or wings 5.

Figure 55:
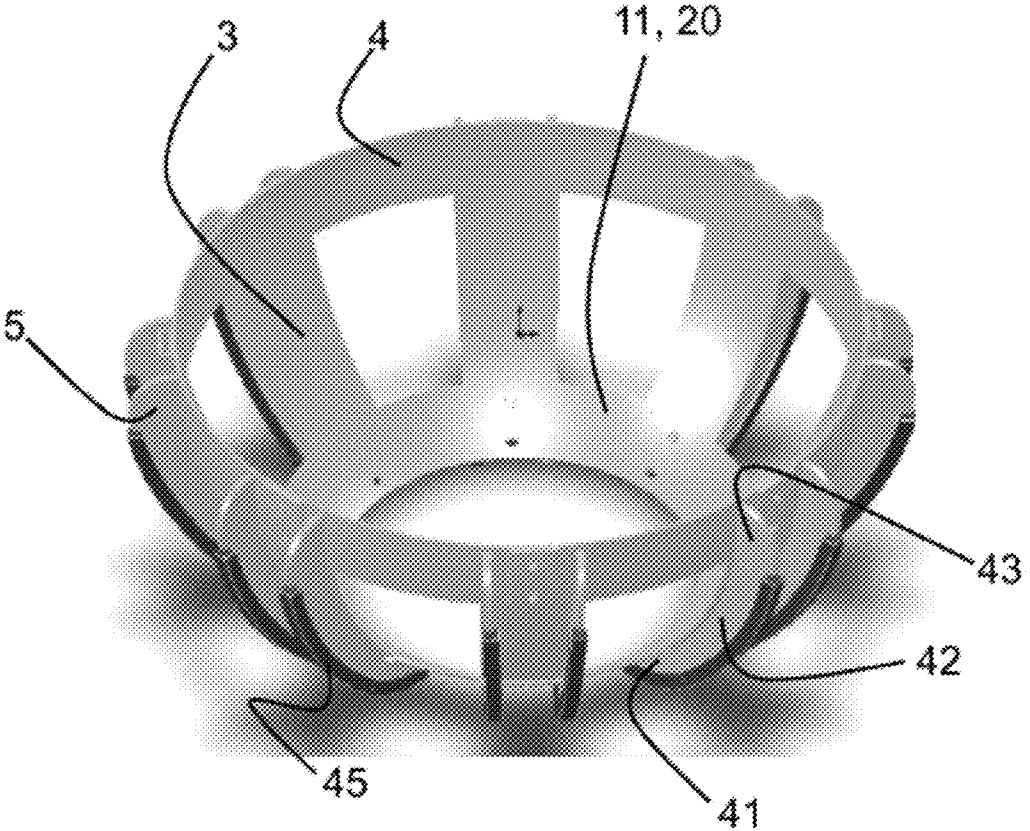
FIG. 55 is a perspective view of the topside of a tenth exemplary embodiment of the exercise device according to the present invention in a fully assembled configuration and as it appears when not applied to a stability ball.

A tenth exemplary embodiment of the exercise device according to the present invention is provided and shown in FIG. 55. There exists the possibility of the ball sliding along the floor due to the significant decrease in the surface area in contact with the floor in the transition from the central hub 20 to the wings. In this particular embodiment, resistance to sliding is provided by the addition of one or more modular enhancers 45 that can be selectively applied to the outside perimeter of each inclined plane or wing 5. The enhancers 45 increase the effective protruding distance, or angle of inclination, of the plane or wing 5 and can be made to grip the floor by being of a skid-resistant material such as silicone rubber. As shown in close detail in FIG. 57, the enhancers 45 are crescent- or arc-like segments shaped to conform to the curvature of at least a portion of the outside perimeter of the inclined planes or wings 5. At the inner arc of the enhancer segment is an interior groove 46 that is shaped to receive the edge of the outside perimeter of the inclined plane or wing 5 such that the enhancer 45 can be securely applied to the edge of the inclined plane or wing 5, when desired. Thus, by selectively applying the enhancers 45 to the outside perimeters of one or more of the inclined planes or wings 5, skidding can be eliminated and/or the effective resistance provided by the enhanced inclined plane(s) or wing(s) can be increased along the entire circumference of the device 2 or, just a specific portion of the circumference of the device 2.

Figures 56, 57:
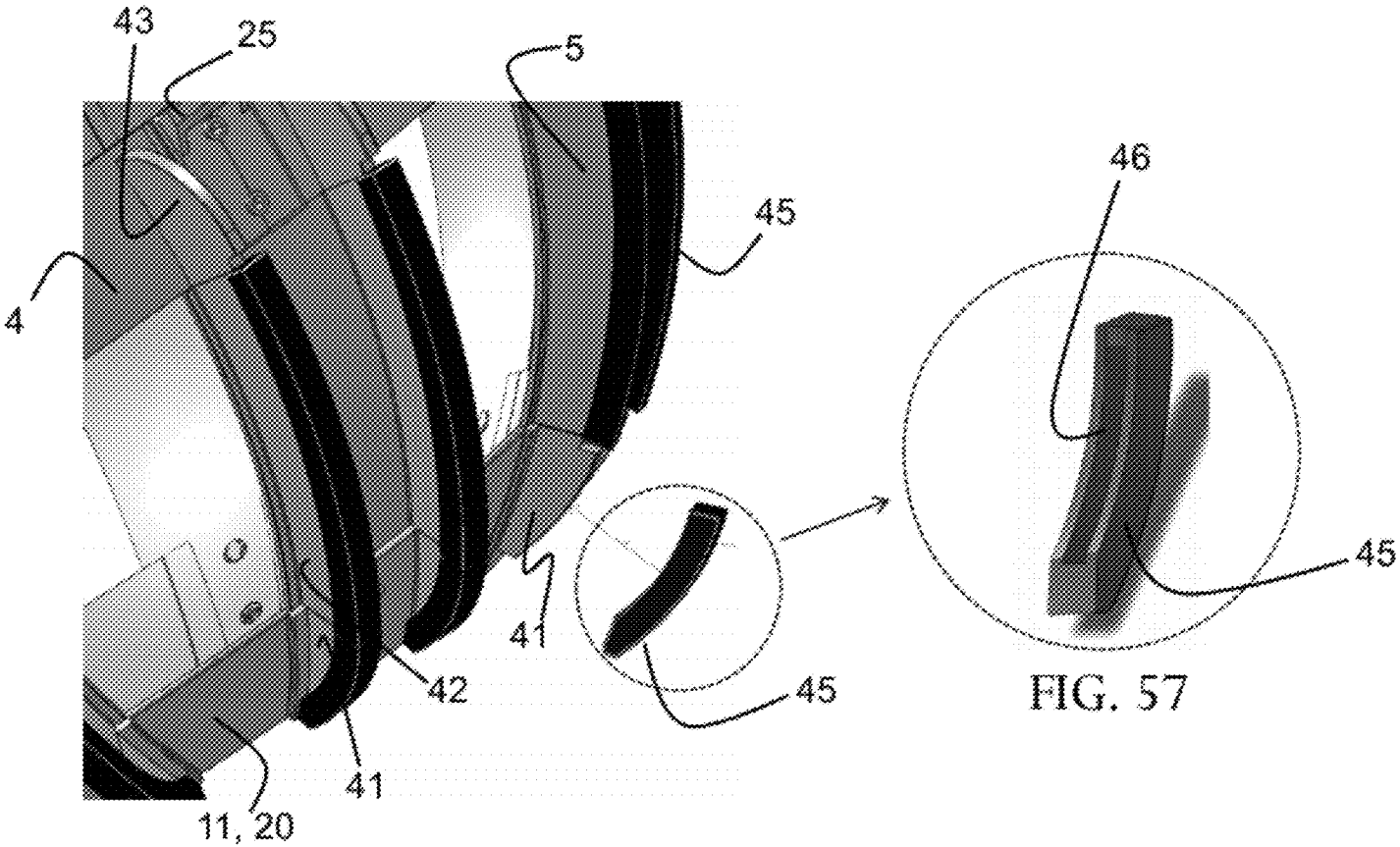
FIG. 56 is a fragmentary perspective and partially exploded view of a portion of the exterior of the exercise device of FIG. 55, showing in close detail the inclined planes or wings of the ribs of the device to which enhancer portions have been applied thereto.
FIG. 57 is an enlarged perspective view of an enhancer portion prior to being applied to the inclined plane or wing of the exercise device of FIG. 56.

As shown in close detail in FIG. 56, the inclined planes or wings 5 may also be structurally comprised of two or more partitions 41, 42, 43 that interlock or otherwise lie adjacent to one another to, together, form the entire plane or wing 5. Accordingly, the enhancers 45 may also be partitioned into separate parts that correspondingly fit each of the partitions 41, 42, 43. By splitting both the plane or wing 5 and the enhancers 45 into separate corresponding segments or parts, each plane or wing 5 can advantageously be divided into separate zones, each zone providing a different or varying degree of resistance. For example, as shown in FIG. 56, the inclined plane or wing 5 can be divided into three parts: a lower partition 41, an intermediate partition 42, and an upper partition 43, thereby creating three different discrete zones along the length of the inclined plane or wing 5. Selectively, the user may only wish to increase the resistance felt at the very beginning of the rolling movement of the ball away from its resting or base position and, therefore, can apply an enhancer 45 only to the lower partition 41 of the device 2. Similarly, the user may wish to only increase the resistance felt at the mid-extension point of the rolling movement of the ball away from its resting or base position and, therefore, can apply an enhancer 45 only to the intermediate partition 42 of the device 2 and leave the lower partition 41 and upper partition 43 as is without the enhancers 45. By being able to vary the amount of resistance felt by the user at different points along the route of the rolling ball, the user can uniquely and dynamically change the intensity of the resulting exercise.

Figure 58:
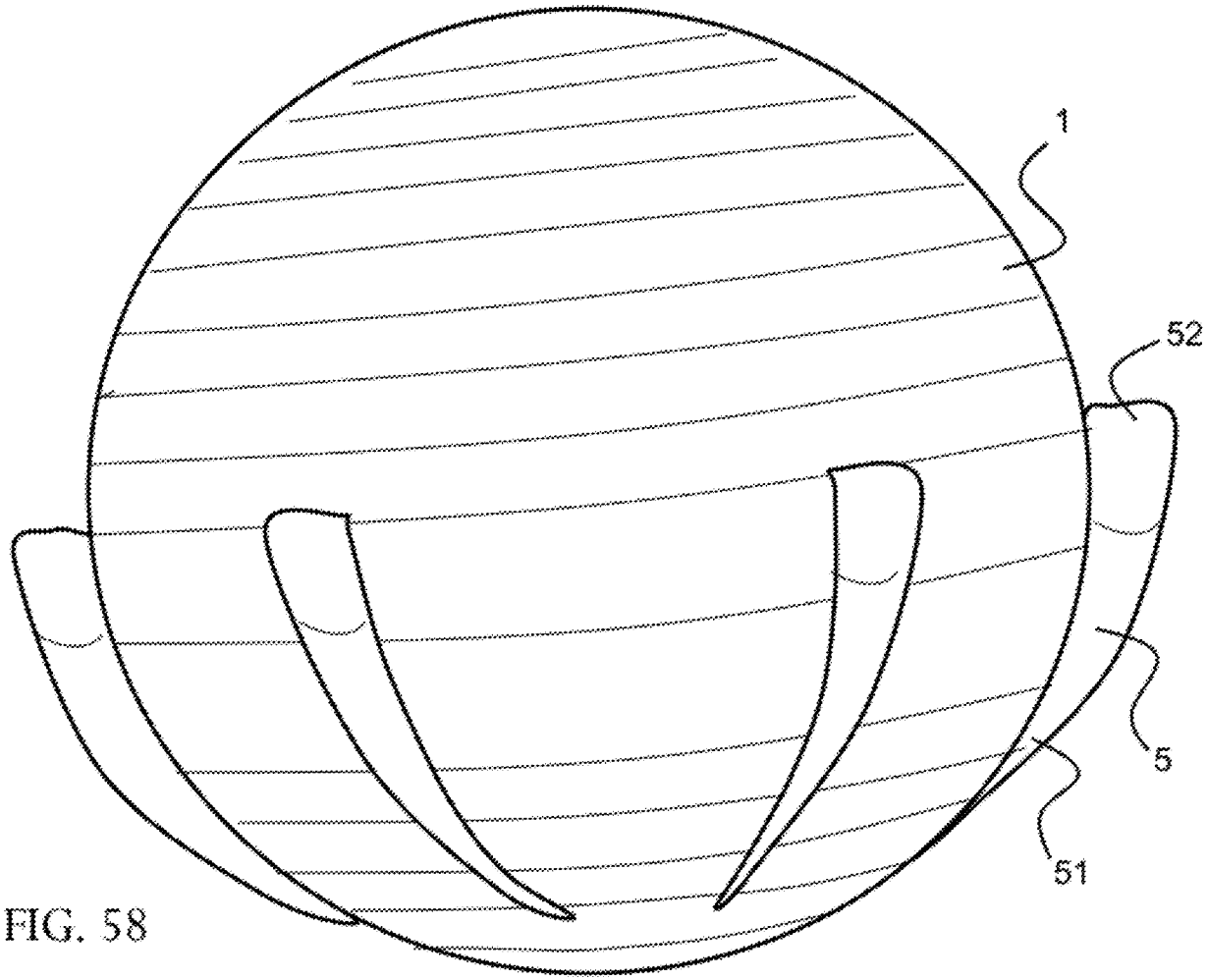
FIG. 58 is a side perspective view of an eleventh exemplary embodiment of the exercise device according to the present invention.

An eleventh exemplary embodiment of the exercise device according to the present invention is provided and shown in FIG. 58. In this embodiment, a plurality of inclined planes or wings 5 are directly attached to or integrally formed at the exterior surface of the ball 1 in a pattern that begins at a bottom portion, or, at any level from the bottom portion to half way up the circumference of the ball 1, and radiates upwards along the spherical exterior surface of the ball to a desired height. Each inclined plane or wing 5 begins at or near the bottom of the ball 1 at one end 51 and steadily increases in its protruding distance, or angle of inclination, as it approaches its opposite, radiating end 52. The increase can continue all the way or partly up the wing 5. In the former exemplary configuration, the wing 5 continues extending outwardly away from the center of the ball 1 to create a wedge-shaped wing 5. In the latter exemplary configuration, the wing 5 continues extending outwardly away from the center of the ball 1 only up to an intermediate portion of the wing 5. The remainder can have a constant outside radius so that the upper portion of the wing 5 is relatively cylindrical or it can decrease in radius until it merges back into the outer surface of the ball 1.

Compared to above-described exemplary embodiments, the hemispherical cage or enclosure formed by the ribs 3, belt 4, and central base or hub 11, 20 is omitted entirely as the inclined planes or wings 5 are directly applied to or formed integrally with the exterior surface of the ball 1. However, in the same manner as described above and as shown in FIGS. 30 and 31, the addition of the inclined planes or wings 5 still provides an incremental amount of resistance to the rolling movement of the ball 1.

Any suitable method of forming the ball 1 with the inclined planes or wings 5 or, applying the inclined planes or wing 5 to the ball's exterior surface, is contemplated to be within the scope and spirit of the present invention. For example, the inclined planes or wings 5 may be initially molded onto or integrally formed with the ball 1 during manufacture. Where the inclined planes or wings 5 are initially formed separately from the ball 1 and, thereafter, are applied to the surface of the ball 1, the inclined planes or wings 5 are necessarily shaped to conform to the spherical exterior of the ball 1. For example, the inclined plane or wing 5 may be made of a flexible (or soft), molded plastic. To attach the inclined plane or wing 5 to the ball 1, a number of temporary, permanent, or semi-permanent adhesive compounds may be used. Alternatively, corresponding VELCRO® fasteners may be applied to adjacent surfaces of the ball 1 and the inclined plane or wing 5. In a further example, a variety of mating mechanical attachments (e.g., a male pin and matching female keyhole-slot) may be used to adjoin corresponding adjacent parts of the ball 1 and inclined plane or wing 5.

Figure 59:
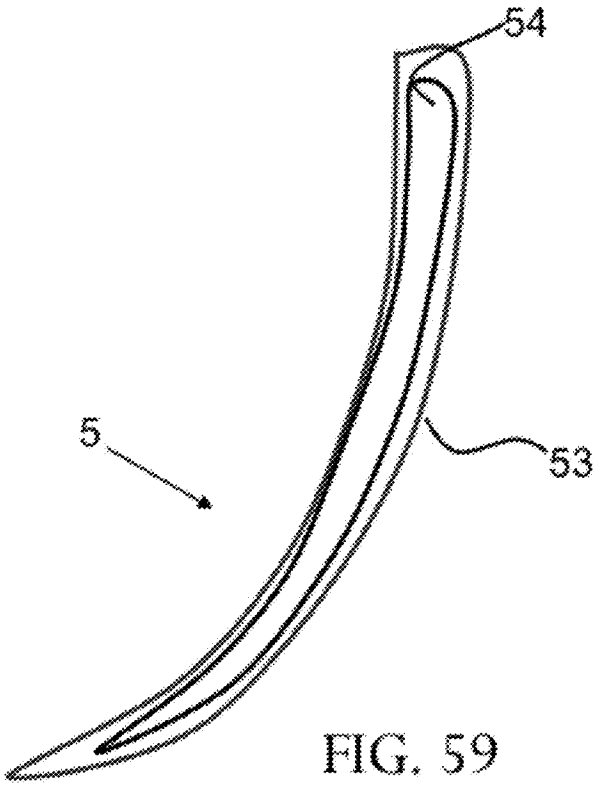
FIG. 59 is a side perspective view of an exemplary embodiment of an inclined plane or wing of the exercise device of FIG. 58.

Additionally, the inclined planes or wings 5 may be formed as one solid piece being part of the ball structure, or may be partially or fully hollow as shown, for example, in FIG. 59. These planes or wings may also be molded in a fashion where the interior of the wing is continuous with the wall of the ball so that support is offered by the internal pressure of the ball and inherent structure of the plane or wing. Further, a combination of solid, hollow, and partially hollow inclined planes or wings 5 may be formed onto or applied to a single ball 1. In the exemplary embodiment shown in FIG. 59, the inclined planes or wings 5 are initially formed as hollow pockets 53 either during or after manufacture of the ball 1. Each of the hollow pockets 53 is open at the bottom, the top, or an intermediate portion. A variable amount of support may be added to the hollow pocket 53 by partially or fully filling it with a weighted substance 54, for example, by injecting plastic into the pocket 53. Then, the opening can be sealed so that the substance 54 is not able to escape from the pocket 53. In an injection method, only a small hole is made. After hardening, the substance 54 becomes too large to exit the injection orifice.

Figure 60:
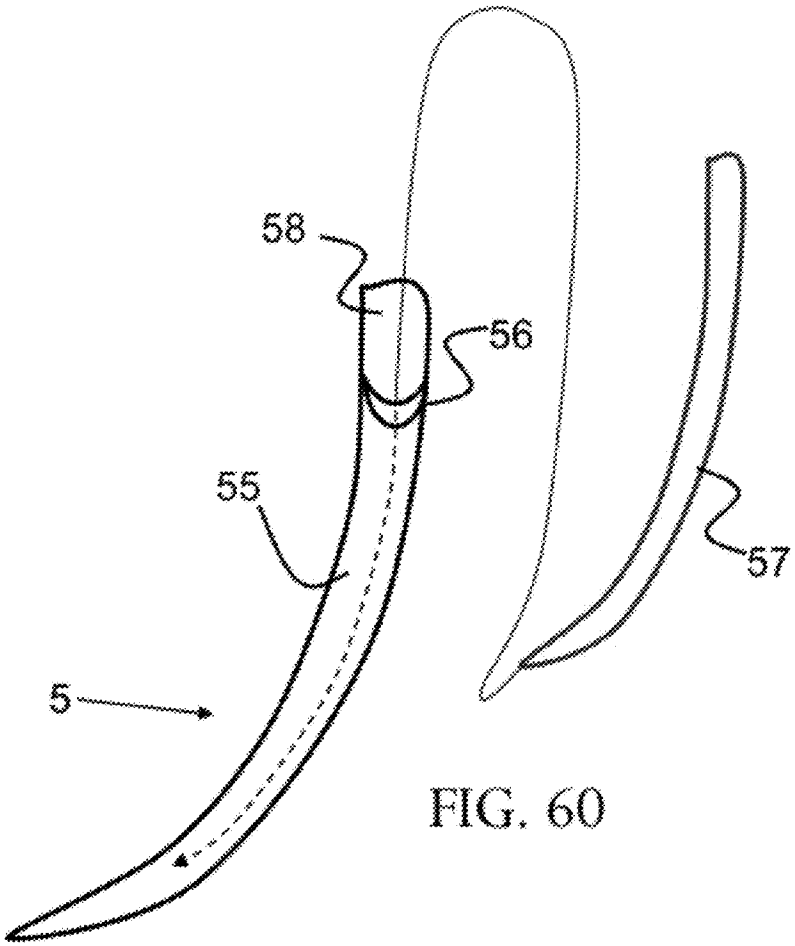
FIG. 60 is a side perspective and exploded view of an exemplary embodiment of a removable inclined plane or wing assembly of the embodiment of FIG. 58.

In the exemplary embodiment shown in FIG. 60, the pocket 55 is akin to a typical pocket open at an intermediate slit 56. A variable amount of support is able to be added to the hollow pocket 55 by inserting removably a correspondingly shaped modular insert 57 within its hollow interior. As depicted in FIG. 60, when desired by the user, the insert 57 is received through the opening or slit 56 of the inclined plane or wing 5 and is slid down into the hollow interior of the plane or wing 5. As the pocket 55 is at least partially elastic, the top portion 58 of the pocket 55 is stretched over the top end 59 of the insert 57 to capture the insert 57 therein and prevent it from falling out during use.

The foregoing description and accompanying drawings illustrate the principles, preferred embodiments and modes of operation of the invention. However, the invention should not be construed as being limited to the particular embodiments discussed above. Additional variations of the embodiments discussed above will be appreciated by those skilled in the art and the above-described embodiments should be regarded as illustrative rather than restrictive. Accordingly, it should be appreciated that variations to those embodiments can be made by those skilled in the art without departing from the scope of the invention as defined by the following claims. Combinations of any number of the various features from the various exemplary embodiments together are contemplated within the scope of the invention.

The above-described embodiments should be regarded as illustrative rather than restrictive. Accordingly, it should be appreciated that variations to those embodiments can be made by those skilled in the art without departing from the scope of the invention as defined by the following claims.

What is claimed is:

1. An exercise device, comprising:

at least one arc-shaped wing structure shaped to conform to a curvature of an exterior surface of an exercise ball such that when applied to the exterior surface of the exercise ball the at least one arc-shaped wing structure:

has a lower proximal end and an upper distal radiating end;

protrudes away from the exterior surface of the exercise ball to a given distance that increases along a direction from the lower proximal end towards the upper distal radiating end; and is operable to provide an increased resistance against a rolling movement of the exercise ball along a surface when the at least one arc-shaped wing structure comes into rolling contact with the surface.

2. The exercise device according to claim 1, further comprising an exercise ball having an exterior surface, the at least one arc-shaped wing structure being integral with the exterior surface of the exercise ball.

3. The exercise device according to claim 1, wherein the at least one arc-shaped wing structure further comprises at least one mechanical structure operable to attach the at least one arc-shaped wing structure to the exterior surface of the exercise ball.

4. The exercise device according to claim 3, wherein the at least one mechanical structure is at least one of temporary, permanent, and semi-permanent.

5. The exercise device according to claim 3, wherein the at least one mechanical structure is an adhesive.

6. The exercise device according to claim 3, wherein the at least one mechanical structure is a hook and loop fastener applied to adjacent surfaces of the ball and the at least one arc-shaped wing structure.

7. The exercise device according to claim 3, wherein the at least one mechanical structure is a male pin and matching female keyhole-slot adjoin corresponding adjacent parts of the ball and the at least one arc-shaped wing structure.

8. The exercise device according to claim 1, further comprising an exercise ball having a spherical exterior surface, the at least one arc-shaped wing structure being shaped to conform to the spherical exterior surface of the ball.

9. The exercise device according to claim 1, wherein the at least one arc-shaped wing structure is of a flexible molded plastic.

10. The exercise device according to claim 1, wherein the at least one arc-shaped wing structure is at least one of solid, partially hollow, and fully hollow.

11. The exercise device according to claim 1, wherein the at least one arc-shaped wing structure is operable to provide an adjustable amount of increased resistance against rolling movement of the exercise ball.

12. The exercise device according to claim 1, wherein the at least one arc-shaped wing structure is a plurality of arc-shaped wing structures.

13. The exercise device according to claim 12, wherein the plurality of arc-shaped wing structures is at least four arc-shaped wing structures symmetrically disposed about the exterior surface of the exercise ball.

14. The exercise device according to claim 12, wherein each of the plurality of arc-shaped wing structures is at least one of solid, partially hollow, and fully hollow.

15. The exercise device according to claim 12, further comprising at least one support, at least one of the partially hollow and fully hollow arc-shaped wing structures defining a pocket operable to receive therein the at least one support.

16. The exercise device according to claim 15, wherein the at least one support is weighted to bias the exercise ball against the rolling movement of the exercise ball along a surface when the at least one arc-shaped wing structure comes into rolling contact with the surface.

17. The exercise device according to claim 12, further comprising a plurality of supports, the partially hollow and fully hollow arc-shaped wing structures each defining a pocket operable to receive therein one of the plurality of supports.

18. The exercise device according to claim 17, wherein each support is user-removable from each of the pockets in the partially hollow and fully hollow arc-shaped wing structures.

19. An exercise device, comprising:

an exercise ball having a curved exterior surface; and at least one arc-shaped wing structure shaped to conform to a curvature of the curved exterior surface of the exercise ball such that when applied to the curved exterior surface of the exercise ball the at least one arc-shaped wing structure:

has a lower proximal end and an upper distal radiating end;

protrudes away from the curved exterior surface of the exercise ball to a given distance that increases along a direction from the lower proximal end towards the upper distal radiating end; and is operable to provide an increased resistance against a rolling movement of the exercise ball along a surface when the at least one arc-shaped wing structure comes into rolling contact with the surface.

20. An exercise device, comprising:

an exercise ball having a curved exterior surface; and at least one arc-shaped wing molded so that it is part of or continuous with the curved exterior surface of the ball and derives its support from internal pressure of the ball and the wing's inherent shape:

has a lower proximal end and an upper distal radiating end;

protrudes away from the curved exterior surface of the exercise ball to a given distance that increases along a direction from the lower proximal end towards the upper distal radiating end;

is operable to provide an increased resistance against a rolling movement of the exercise ball along a surface when the at least one arc-shaped wing comes into rolling contact with the surface; and inflates along with the exercise ball as a single unit.

* * * * *